US008543015B2

(12) United States Patent
Tokuno et al.

(10) Patent No.: US 8,543,015 B2
(45) Date of Patent: Sep. 24, 2013

(54) REPLACEMENT TONER CARTRIDGE MANAGEMENT APPARATUS, REPLACEMENT TONER CARTRIDGE MANAGEMENT SYSTEM, IMAGE FORMING APPARATUS, REPLACEMENT TONER CARTRIDGE MANAGEMENT METHOD, AND RECORDING MEDIUM

(75) Inventors: Toshiyuki Tokuno, Toyokawa (JP); Atsushi Kawai, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 251 days.

(21) Appl. No.: 13/184,111

(22) Filed: Jul. 15, 2011

(65) Prior Publication Data

US 2012/0014701 A1 Jan. 19, 2012

(30) Foreign Application Priority Data

Jul. 16, 2010 (JP) ..... 2010-162323

(51) Int. Cl.
*G03G 15/00* (2006.01)

(52) U.S. Cl.
USPC ..... 399/12; 399/8; 399/27

(58) Field of Classification Search
USPC ..... 399/8, 12, 24, 25, 27
See application file for complete search history.

(56) References Cited

U.S. PATENT DOCUMENTS

| | | | | |
|---|---|---|---|---|
| 6,798,995 | B2 | 9/2004 | Nagata | |
| 7,711,274 | B2 * | 5/2010 | Zaima | 399/24 |
| 8,184,997 | B2 * | 5/2012 | Hadano | 399/27 |
| 2002/0159777 | A1 | 10/2002 | Nagata | |

FOREIGN PATENT DOCUMENTS

| | | | |
|---|---|---|---|
| JP | 2002-297969 | A | 10/2002 |
| JP | 2006-079529 | A | 3/2006 |
| JP | 2006-259145 | A | 9/2006 |
| JP | 2006-313226 | A | 11/2006 |
| JP | 2007-057632 | A | 3/2007 |
| JP | 2008-017082 | A | 1/2008 |
| JP | 2008-243018 | A | 10/2008 |
| JP | 2008-271231 | A | 11/2008 |

OTHER PUBLICATIONS

Office Action (Notification of Reasons for Refusal) dated Jun. 5, 2012, issued in corresponding Japanese Patent Application No. 2010-162323, and an English Translation thereof. (4 pages).

* cited by examiner

*Primary Examiner* — Hoang Ngo
(74) *Attorney, Agent, or Firm* — Buchanan Ingersoll & Rooney PC

(57) ABSTRACT

A replacement toner cartridge management apparatus is provided with: a receiver which receives toner cartridge replacement information indicating a toner cartridge loaded on an image forming apparatus which the replacement toner cartridge management apparatus can access via a communication circuit, has been replaced with a new one; an information obtainer which obtains remaining toner information of the toner cartridge removed from the image forming apparatus, when the toner cartridge replacement information is received by the receiver; a time determiner which, if the remaining toner information obtained by the information obtainer indicates a value smaller than a predetermined value, determines that an instruction to deliver a replacement toner cartridge should be outputted when the toner cartridge replacement information is received, or if the remaining toner information indicates a value larger than or equal to a predetermined value, determines that an instruction to deliver a replacement toner cartridge should be outputted at a different time; and a transmitter which outputs a delivery instruction according to the determination made by the time determiner.

18 Claims, 13 Drawing Sheets

| Remaining Toner Information | Permit/ Prohibit Printing | Panel Display | Toner State |
|---|---|---|---|
| Normal | Permit printing | (No message displayed) | The sub-hopper and the toner cartridge hold enough toner. |
| Toner Near Empty | Permit printing | One-line message: "There will be a need for toner cartridge replacement in a short time." | The sub-hopper holds some toner but the toner cartridge nearly runs out of toner. |
| Toner Empty (permit printing) | Permit printing | One-line message: "The toner cartridge is running out of toner. Please replace." | The sub-hopper holds some toner but the toner cartridge absolutely runs out of toner. |
| Toner Empty (prohibit printing) | Prohibit printing | Strong Alert message: "The toner cartridge has run out of toner. Please immediately replace and close the toner garage door." | The sub-hopper and the toner cartridge absolutely run out of toner, and printing is not available any more due to low toner concentration. |

FIG.10

| | | PV | | |
|---|---|---|---|---|
| | | less than 100 copies per day | 100 or more, less than 500 copies per day | 500 or more copies per day |
| Remaining Toner Level of the Removed Toner Cartridge | Nearly Empty | × | △ | ○ |
| | Empty (permit printing) Empty (prohibit printing) | ○ | ○ | ○ |

| | | Coverage | | |
|---|---|---|---|---|
| | | lower than 75% | 25% or higher, lower than 75% | 65% or higher |
| Remaining Toner Level of the Removed Toner Cartridge | Nearly Empty | × | △ | ○ |
| | Empty (permit printing) Empty (prohibit printing) | ○ | ○ | ○ |

FIG.15

REPLACEMENT TONER CARTRIDGE MANAGEMENT APPARATUS, REPLACEMENT TONER CARTRIDGE MANAGEMENT SYSTEM, IMAGE FORMING APPARATUS, REPLACEMENT TONER CARTRIDGE MANAGEMENT METHOD, AND RECORDING MEDIUM

This application claims priority under 35 U.S.C. §119 to Japanese Patent Application No. 2010-162323 filed on Jul. 16, 2010, the entire disclosure of which is incorporated herein by reference in its entirety.

BACKGROUND OF THE INVENTION

1. Field of the Invention

The present invention relates to a replacement toner cartridge management apparatus that determines the right time to output an instruction to deliver a replacement toner cartridge when there is a need to replace a toner cartridge loaded on an image forming apparatus; a replacement toner cartridge management system employing the replacement toner cartridge management apparatus; an image forming apparatus employed in the replacement toner cartridge management system; a replacement toner cartridge management method; a recording medium having a replacement toner cartridge management program stored thereon to make a computer of the replacement toner cartridge management apparatus implement the replacement toner cartridge management method; and a recording medium having a replacement toner cartridge management program stored thereon to make a computer of the image forming apparatus implement the replacement toner cartridge management method.

2. Description of the Related Art

The following description sets forth the inventor's knowledge of related art and problems therein and should not be construed as an admission of knowledge in the prior art.

Conventionally, if the remaining consumable resource in a consumable unit loaded on an image forming apparatus such as a digital photo copier, a digital photo printer, or a multi-functional machine called MFP (Multi Function Peripheral), for example, the remaining toner in a toner cartridge is lower than a predetermined level, the image forming apparatus determines that the toner cartridge nearly runs out of toner (the toner cartridge is in toner near empty state) and displays for the user a message stating that the toner cartridge nearly runs out of toner, on a display panel provided thereon. Noticing this message, the user prepares a replacement toner cartridge, or places an order for a replacement toner cartridge if not having any ones in stock.

Meanwhile, in recent years, an image forming apparatus connected with a management apparatus to exchange information with has been more commonly used in a remote management system (for example, Japanese Unexamined Patent Publication No. 2002-297969). In many cases, a retailer of image forming apparatuses or a provider of office supplies have their own management apparatus in their own place, in order to collect, store, and manage for their business, various types of information including toner near empty information from a plurality of image forming apparatuses in their users' places. Being connected with the image forming apparatuses, the management apparatus is capable of recognizing that the toner cartridges nearly run out toner and that these are replaced with new ones.

In some cases, the management apparatus is further connected with an order receiving apparatus receiving orders for a replacement toner cartridge (for example, Japanese Unexamined Patent Publication No. 2008-271231). In such a case, the management apparatus further transmits an order to the order receiving apparatus, so that a replacement toner cartridge will be delivered to the user. In other words, this is exactly a system to automatically deliver a replacement toner cartridge to users while they need not bother to place an order for it.

Such an automatic order and delivery system is very useful if the manufacturer and the user are in an agreement about billing and payment for the use of an image forming apparatus. In accordance with such an agreement, the user pay a service fee for making one copy, which includes a charge for the toner used for the copy. That is, it is convenient for the user to pay a service fee simply depending on the number of copies regardless of how many replacement toner cartridges they ordered and have a replacement toner cartridge automatically delivered without the need for placing an order for it. At the same time, the manufacturer can expect a benefit from saving the costs of handling order transactions.

With such a system in which a management apparatus automatically places an order for a replacement toner cartridge, it is preferred that a toner cartridge containing as little remaining toner as possible is replaced with a new one, in terms of cost-effectiveness.

However, a delivery instruction is conventionally outputted when a toner cartridge, regardless of the amount of toner remaining in it, is replaced with a new one, which causes a toner wasting problem.

And such a problem cannot be resolved using the technologies disclosed in the Japanese Unexamined Patent Publications No. 2002-297969 and No. 2008-271231.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

According to a first aspect of the present invention, a replacement toner cartridge management apparatus is provided with:

a receiver which receives toner cartridge replacement information indicating a toner cartridge loaded on an image forming apparatus which the replacement toner cartridge management apparatus can access via a communication circuit, has been replaced with a new one;

an information obtainer which obtains remaining toner information of the toner cartridge removed from the image forming apparatus, when the toner cartridge replacement information is received by the receiver;

a time determiner which, if the remaining toner information obtained by the information obtainer indicates a value smaller than a predetermined value, determines that an instruction to deliver a replacement toner cartridge should be outputted when the toner cartridge replacement information is received, or if the remaining toner information indicates a value larger than or equal to a predetermined value, determines that an instruction to deliver a replacement toner cartridge should be outputted at a different time; and a transmitter which outputs a delivery instruction according to the determination made by the time determiner.

According to a second aspect of the present invention, a replacement toner cartridge management system is provided with an image forming apparatus having one or more than one toner cartridge loaded thereon and a management apparatus which can access each other via a communication circuit, wherein:

the image forming apparatus is provided with a transmitter which transmits toner cartridge replacement information indicating that one of the toner cartridges has been replaced with a new one, and the management apparatus is provided with:

a receiver which receives the toner cartridge replacement information;

an information obtainer which obtains remaining toner information of the removed toner cartridge when the toner cartridge replacement information is received by the receiver;

a time determiner which, if the remaining toner information obtained by the information obtainer indicates a value smaller than a predetermined value, determines that an instruction to deliver a replacement toner cartridge should be outputted when the toner cartridge replacement information is received, or if the remaining toner information indicates a value larger than or equal to a predetermined value, determines that an instruction to deliver a replacement toner cartridge should be outputted at a different time; and a transmitter which outputs a delivery instruction at the time determined by the time determiner.

According to a third aspect of the present invention, an image forming apparatus is provided with:

a receiver which receives toner cartridge replacement information indicating that a toner cartridge loaded on the image forming apparatus or a different image forming apparatus which the image forming apparatus can access via a communication circuit has been replaced with a new one;

an information obtainer which obtains remaining toner information of the removed toner cartridge when the toner cartridge replacement information is received by the receiver;

a time determiner which, if the remaining toner information obtained by the information obtainer indicates a value smaller than a predetermined value, determines that an instruction to deliver a replacement toner cartridge should be outputted when the toner cartridge replacement information is received, or if the remaining toner information indicates a value larger than or equal to a predetermined value, determines that an instruction to deliver a replacement toner cartridge should be outputted at a different time; and a transmitter which outputs a delivery instruction at the time determined by the time determiner.

According to a fourth aspect of the present invention, a replacement toner cartridge management method for a system provided with an image forming apparatus having one or more than one toner cartridge loaded thereon and a management apparatus which can access each other via a communication circuit, comprising:

the image forming apparatus's transmitting toner cartridge replacement information indicating one of the toner cartridges has been replaced with a new one, and the management apparatus's:

receiving the toner cartridge replacement information;

obtaining remaining toner information of the removed toner cartridge when the toner cartridge replacement information is received;

if the obtained remaining toner information indicates a value smaller than a predetermined value, determining that an instruction to deliver a replacement toner cartridge should be outputted when the toner cartridge replacement information is received, or if the obtained remaining toner information indicates a value larger than or equal to a predetermined value, determining that an instruction to deliver a replacement toner cartridge should be outputted at a different time; and outputting a delivery instruction according to the determination.

According to a fifth aspect of the present invention, a non-transitory computer-readable recording medium having a replacement toner cartridge management program stored thereon to make a computer of a management apparatus execute:

receiving toner cartridge replacement information indicating a toner cartridge loaded on an image forming apparatus which the management apparatus can access via a communication circuit has been replaced with a new one;

obtaining remaining toner information of the removed toner cartridge when the toner cartridge replacement information is received;

if the obtained remaining toner information indicates a value smaller than a predetermined value, determining that an instruction to deliver a replacement toner cartridge should be outputted when the toner cartridge replacement information is received, or if the obtained remaining toner information indicates a value larger than or equal to a predetermined value, determining that an instruction to deliver a replacement toner cartridge should be outputted at a different time; and outputting a delivery instruction according to the determination.

According to a sixth aspect of the present invention, a non-transitory computer-readable recording medium having a replacement toner cartridge management program stored thereon to make a computer of an image forming apparatus execute:

receiving toner cartridge replacement information indicating a toner cartridge loaded on the image forming apparatus or a different image forming apparatus which the image forming apparatus can access via a communication circuit has been replaced with a new one;

obtaining remaining toner information of the removed toner cartridge when the toner cartridge replacement information is received;

if the obtained remaining toner information indicates a value smaller than a predetermined value, determining that an instruction to deliver a replacement toner cartridge should be outputted when the toner cartridge replacement information is received, or if the obtained remaining toner information indicates a value larger than or equal to a predetermined value, determining that an instruction to deliver a replacement toner cartridge should be outputted at a different time; and outputting a delivery instruction according to the determination.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 10 is a table illustrating the statuses depending on remaining toner level;

FIG. 15 is a table to determine the right time to output an instruction to deliver a replacement toner cartridge depending on the conditions.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, one mode of implementing the present invention will be described with reference to the accompanying drawings.

Figure 1:
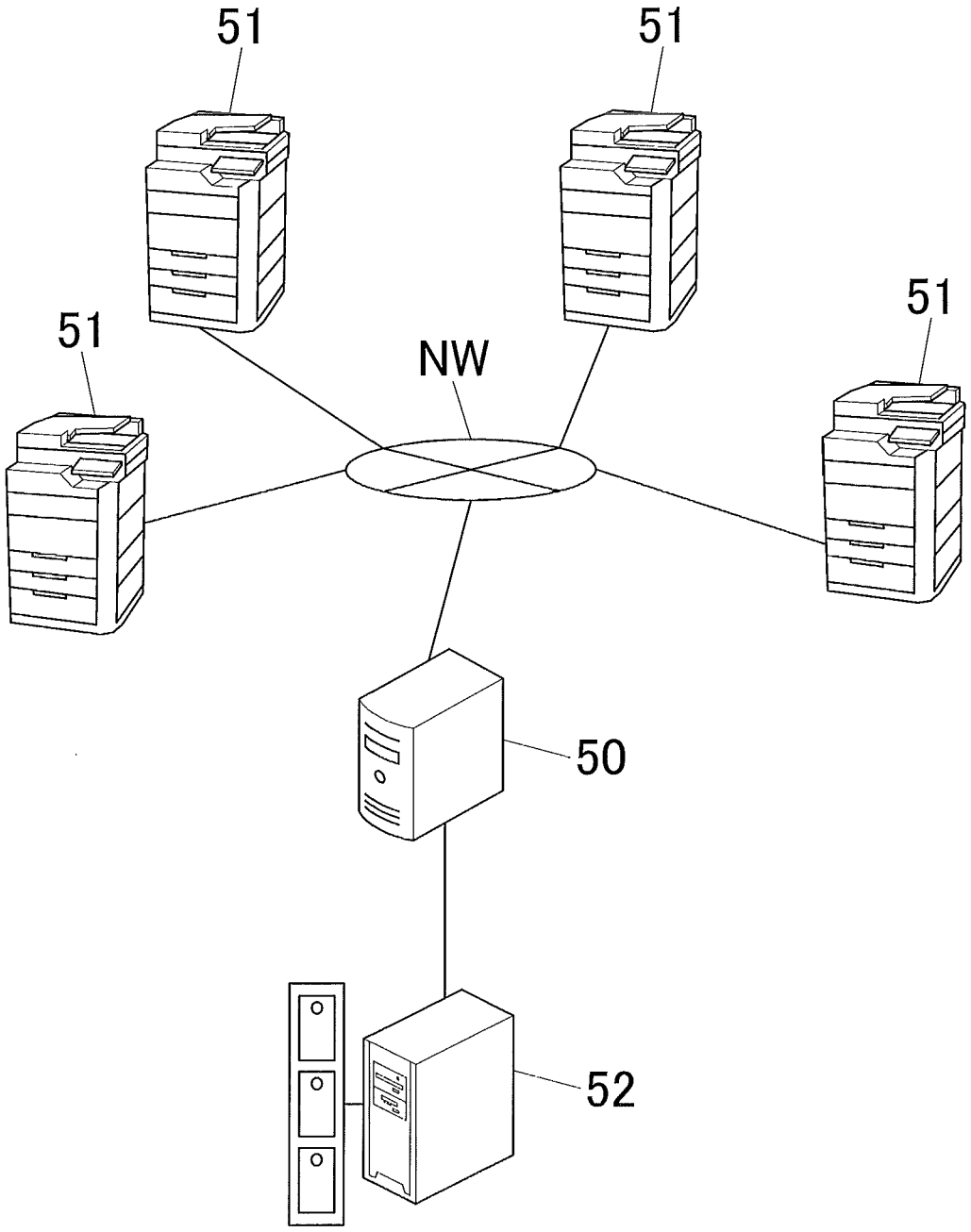
FIG. 1 is a view illustrating a configuration of a replacement toner cartridge management system according to one mode of implementing the present invention.

FIG. 1 is a view schematically illustrating a configuration of a replacement toner cartridge management system according to one mode of implementing the present invention.

As illustrated in FIG. 1, this management system is basically provided with one or more than one image forming apparatus 51 and a management server 50, which are connected to each other via a communication circuit such as Internet. The management server 50 is further connected to an order receiving server 52 via the Internet or the like.

The management server 50 is ordinarily provided in a service center or the like taking care of the image forming apparatuses 51 to manage information of the image forming apparatuses 51 by user accounts. More specifically, by communicating with the image forming apparatuses 51, the management server 50 monitors the remaining toner level(s) of a single toner cartridge or plural toner cartridges containing one color or different colors of toner that is a consumable resource, loaded on each of the image forming apparatuses 51, and if there is a replacement toner cartridge(s) for the toner cartridge(s) in stock. That will be further described in detail later. The image management server 50 further manages billing transactions and maintenance issues by collecting billing information such as number of prints and trouble information from the image forming apparatuses 51.

Users may use different types of image forming apparatuses; the image forming apparatuses 51 may be of different types. For example, the image forming apparatuses 51 may be printers, full-color copiers, monochrome copiers, and the like. Therefore, the image forming apparatuses 51 may load four toner cartridges containing four colors of toner: yellow (Y), magenta (M), cyan (C), and black (K), or only one toner cartridge containing one color of toner, black (K).

Furthermore, by monitoring unique uses and use patterns of the users, the management server 50 remotely controls the image forming apparatuses 51 for perfect performance based on settings and the like of the image forming apparatuses 51 stored on its own recording medium. The setting information of the image forming apparatuses 51 is integrally managed by the management server 50; it therefore can be changed by the management server 50 quite easily even if some of the image forming apparatuses 51 are located in remote areas.

The image forming apparatuses 51 and the management server 50 exchange information with each other, for example by e-mails via the Internet network.

Being further connected to the order receiving server 52, the management server 50 transmits an order for a replacement toner cartridge to the order receiving server 52 according to information indicating a need of toner cartridge replacement received from the image forming apparatuses 51, so that the order receiving server 52 can arrange for an automatic delivery.

Figure 2:
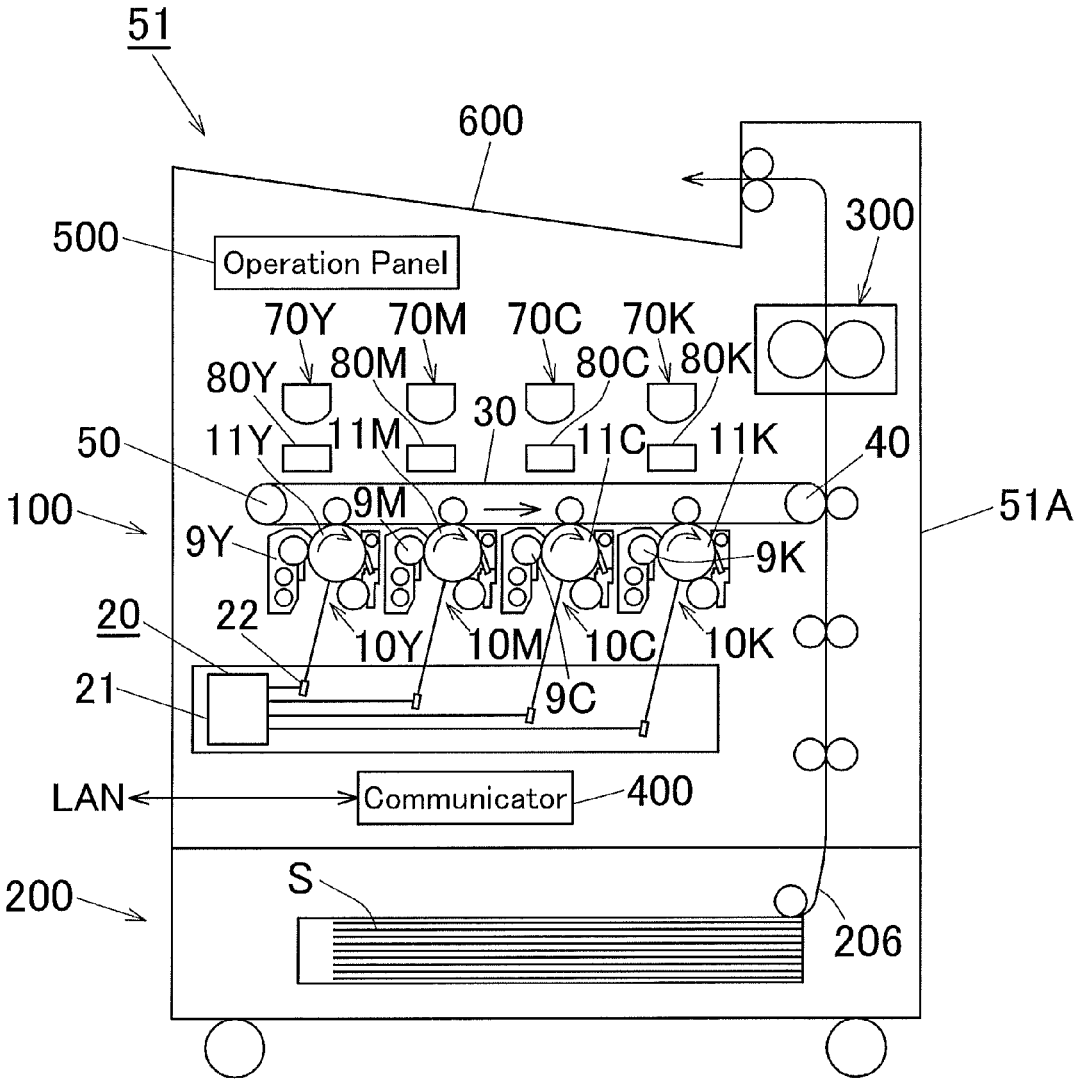
FIG. 2 is a view schematically illustrating a configuration of an image forming apparatus employed in the replacement toner cartridge management system of FIG. 1.

FIG. 2 is a view schematically illustrating a configuration of the image forming apparatus 51. In this example, a tandem color printer is employed as the image forming apparatus 51.

As illustrated in FIG. 1, the image forming apparatus 51 has a paper feeder 200 in the lower area of the body 51A, a color image former 100 in the middle area of the body 51A, and a paper discharger 600 in the upper area of the body 51A, respectively. A paper conveyance path 206 conveying toward the upper area, paper (a sheet of paper) S provided by the paper feeder 200 is extended all the way from the paper feeder 200 to the paper discharger 600.

The color image former 100 includes: a driving roller 40 and a driven roller 50 provided in the middle area of the vertical direction of the body 51A; a midway transfer belt 30 horizontally going around a group of the driving roller 40 and the driven roller 50 to run toward the direction indicated by arrow; and image forming units 10Y, 10M, 10C, and 10K containing yellow (Y), magenta (M), cyan (C), and black (K) of toner, respectively, provided along the belt's running direction.

Toner images formed by the image forming units 10Y, 10M, 10C, and 10K are layered together and transferred onto the transfer belt 30. In the second transfer process, the merged toner images are further transferred on the paper S passing trough the corner of the transfer belt 30 (on the extreme right of the body) via the paper conveyance path 206; the sheet S is conveyed to a fuser 300 to have the merged toner images fixed thereon.

The image forming units 10Y, 10M, 10C, and 10K forming images by the electrostatic copy method is provided with: a charger; a print head 21 including four laser diodes, a polygon mirror, a scanner lens, and the like; an exposure unit 20 including four reflection mirrors 22 and the like; development devices 9Y, 9M, 9C, and 9K; photoreceptor drums 11Y, 11M, 11C, and 11K; a transfer portion; and the like, which are all located in the vicinity of the image forming units themselves.

Above the image forming units 10Y, 10M, 10C, and 10K, toner cartridges 70Y, 70M, 70C, and 70K and sub-hoppers 80Y, 80M, 80C, and 80K are provided as supplier machineries that feed toner in the development devices 9Y, 9M, 9C, and 9K of the image forming units 10Y, 10M, 10C, and 10K, respectively.

The toner cartridges 70Y, 70M, 70C, and 70K are removably loaded on the body 51A so as to be replaced with new ones when need. The toner cartridges 70Y, 70M, 70C, and 70K have a fuse attached thereto but not illustrated in this drawing; the body 51A detects an unused state of the toner cartridges when their fuses are conductive, and releases the unused state when the fuses are cut out. In other words, cutting the fuses, replacement of the toner cartridges is recognized.

In FIG. 1, a portion with the number 400 is a communicator communicating with external machines, and a portion with the number 500 is an operation panel provided with a set of keys and a display.

Figure 3:
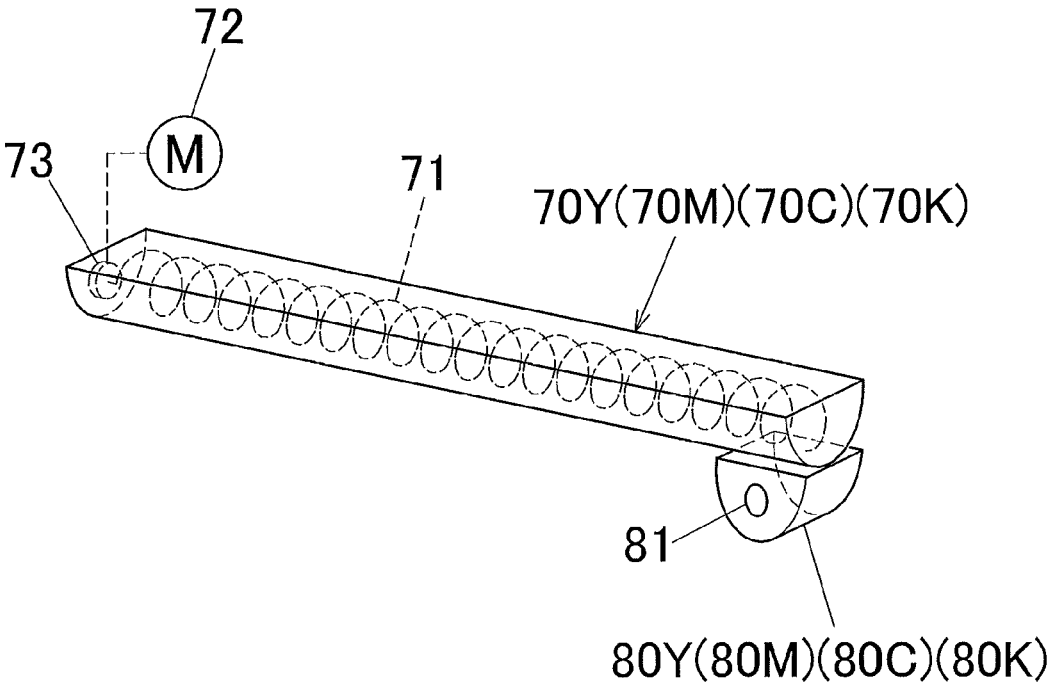
FIG. 3 is a view to explain the image forming apparatus's machinery to feed toner in a sub-hopper from a toner cartridge.

FIG. 3 is a view to explain a machinery to feed toner in the sub-hoppers 80Y, 80M, 80C, and 80K from the toner cartridges 70Y, 70M, 70C, and 70K, respectively.

As illustrated in FIG. 3, when the toner cartridges 70Y, 70M, 70C, and 70K are loaded on the body 51A, the sub-hoppers 80Y, 80M, 80C, and 80K open shutters on their top to receive toner from the toner cartridges 70Y, 70M, 70C, and 70K.

The toner cartridge 70Y, 70M, 70C, and 70K have a spiral spring 71 inside, and feed toner in the sub-hoppers 80Y, 80M, 80C, and 80K, respectively, by having their spiral springs 71 rotated by stepper motors (also referred to as cartridge motors) 72.

There provided two stepper motors 72 for the four spiral springs 71; one of the two works for the toner cartridges 70Y and 70M, and the other one works for the toner cartridges 70C and 70K. An even number of gears 73 are arranged between an inlet valve of the toner cartridges 70Y and 70C and an inlet valve for the toner cartridges 70K and 70M; when the stepper motors 72 perform normal rotation, the spiral springs 71 of the toner cartridges 70Y and 70C are properly rotated while the spiral springs 71 of the toner cartridges 70K and 70M are rotated idle, and when the stepper motors 72 perform reverse rotation, the spiral springs 71 of the toner cartridges 70Y and 70C are rotated idle while the spiral springs 71 of the toner cartridges 70K and 70M are properly rotated. Switching the stepper motors 72 between normal rotation and reverse rotation determines whether or not to allow the toner cartridges 70Y, 70M, 70C, and 70K to feed toner.

Figure 4:
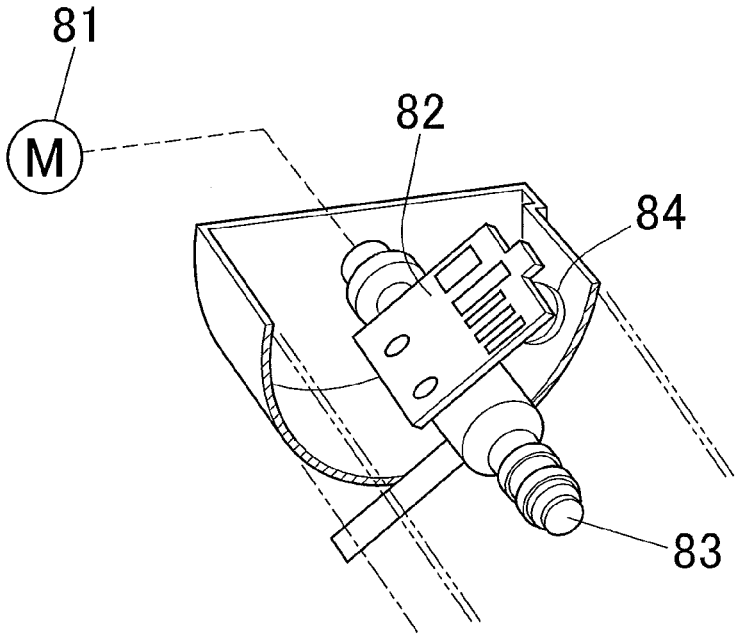
FIG. 4 is a view to explain the image forming apparatus's machinery to feed toner in a development device from the sub-hopper.

FIG. 4 is a view to explain a machinery to feed toner in the development devices 9Y, 9M, 9C, and 9K from the sub-hoppers 80Y, 80M, 80C, and 80K.

As illustrated in FIG. 4, there provided one stepper motor (also referred to as sub-hopper motor) 81 for each of the sub-hoppers, the sub-hoppers 80Y, 80M, 80C, and 81K.

The sub-hoppers 80Y, 80M, 80C, and 80K feed toner in the development devices 9Y, 9M, 9C, and 9K, respectively, by having paddles 82 and spiral rollers 83 inside of themselves rotated by the sub-hopper motors 81. The remaining toner levels of the sub-hoppers 80Y, 80M, 80C, and 80K are detected by a toner empty sensor (piezoelectric sensor) 84.

Figure 5:
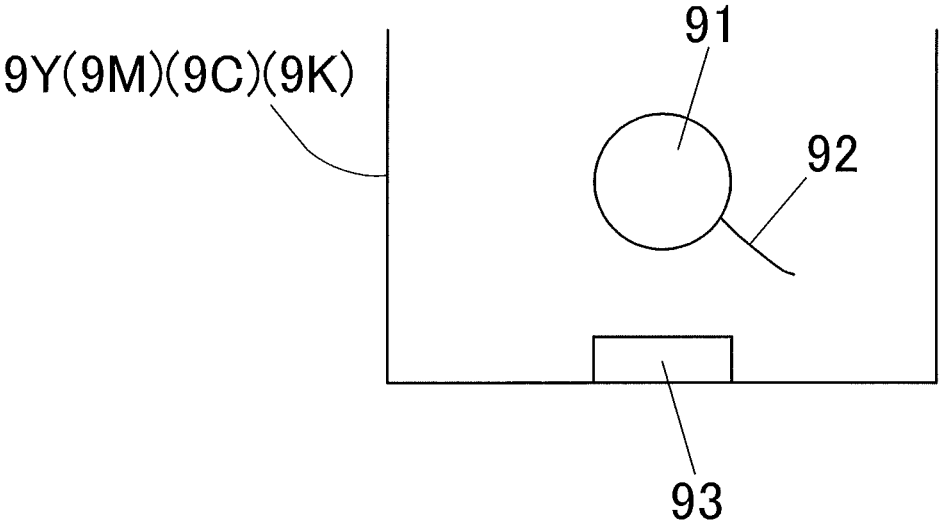
FIG. 5 is a view schematically illustrating a configuration of a machinery to measure toner concentration.

FIG. 5 is a view schematically illustrating a configuration of a machinery to measure toner concentration.

As illustrated in FIG. 5, the development devices 9Y, 9M, 9C, and 9K is filled with developing agent (toner and carrier); the developing agent in the development devices 9Y, 9M, 9C, and 9K is stirred by a Mylar plastic fin 92 attached to a motor-driven screw agitator 91. While the developing agent in the periphery of a toner concentration sensor 93 provided on the bottom of the development devices 9Y, 9M, 9C, and 9K is stirred by the Mylar plastic fin 92, new developing agent is let in the periphery of the toner concentration sensor 93. In other words, the developing agent in the periphery of the toner concentration sensor 93 is replaced with new one every other turn (ripple) of the screw agitator 91.

The toner concentration sensor 93 is a TCR sensor (magnetic sensor), for example. The toner concentration sensor 93 measures the toner concentration of the developing agent by reading out the magnetic permeability of iron included in the carrier of a unit volume of the developing agent in the periphery of the toner concentration sensor 93. That is, the higher a converted value (10-bit resolution) of an analog signal read out by the toner concentration sensor 93 is, the lower the toner concentration is.

Figure 6:
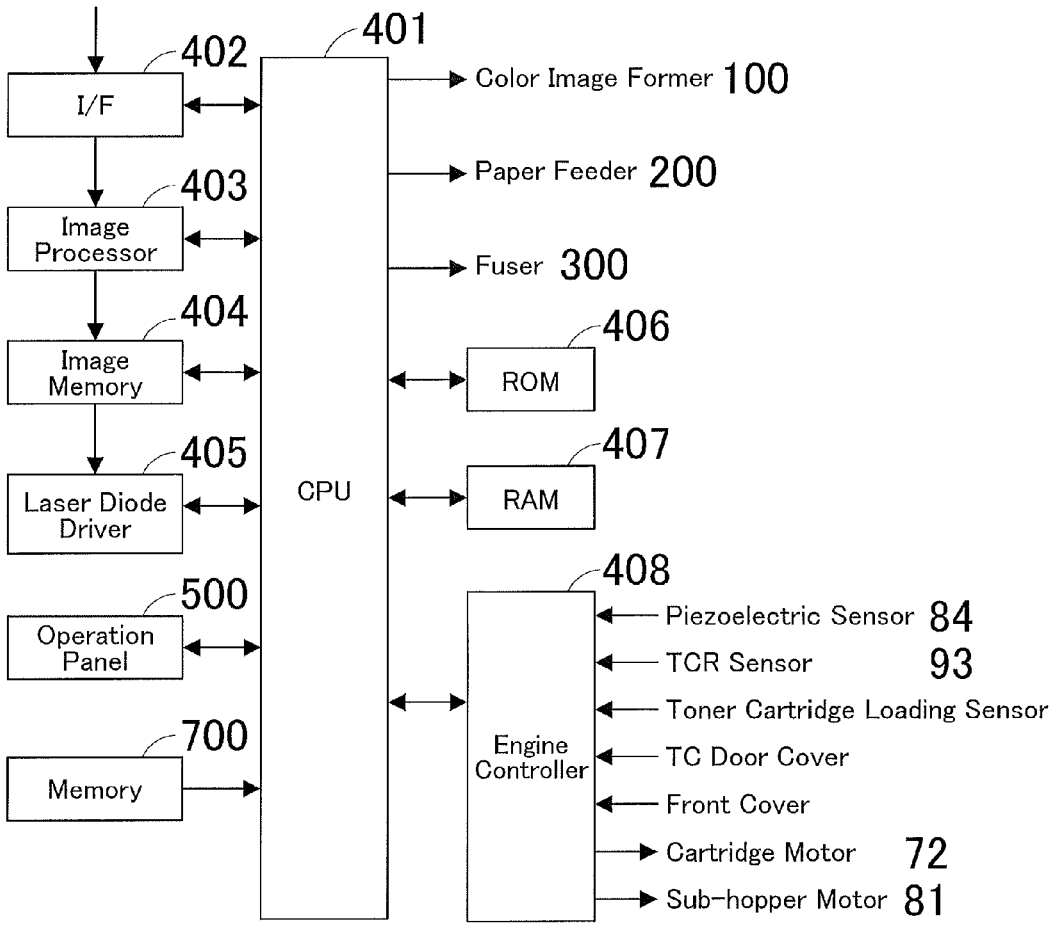
FIG. 6 is a block diagram illustrating a configuration of a controller of the image forming apparatus of FIG. 2.

FIG. 6 is a block diagram illustrating a configuration of a controller of the image forming apparatus 51.

As illustrated in FIG. 6, the controller includes a CPU 401, a communication interface (I/F) 402, an image processor 403, an image memory 404, a laser diode driver 405, an operation panel 500, a recording medium 700, a ROM 406, a RAM 407, and an engine controller 408, as primary members.

The CPU 401 integrally controls all operations of the image forming apparatus 51. Also, the CPU 401 reads out a necessary program from the ROM 406; converts image data by the image processor 403; and writes and reads image data in and out from the image memory 404. Furthermore, the CPU 401 contributes to smooth printing operation by nicely arranging the times of a series of sequential operations of the color image former 100, the paper feeder 200, and the like. Furthermore, based on various information inputted from the engine controller 408, the CPU 401 detects a toner near empty state and an empty state of the toner cartridge 70Y, 70M, 70C, and 70K; detects the remaining toner level of a replaced toner cartridge; detects the condition due to toner consumption data (print volume, ratio Black to White, and the like); and displays a predetermined message about the time for replacing the toner cartridges 70Y, 70M, 70C, and 70K, on the operation panel 500.

The communication I/F 402 serves to connect the image forming apparatus 51 to a LAN such as a LAN card or a LAN board, and externally receives data to be printed out according to a print job and transfers it to the image processor 403.

Also, the communication I/F 402 transmits toner empty information, alert information, trouble information, and information of various printing events to the management server 50 managing the image forming apparatus 51 (see FIG. 13) via the Internet, and receives data and an instruction from the administration server 50.

Receiving data to be printed out according to a print job from the communication I/F 402, the image processor 403 converts the data into Y, M, C, and K image data objects for color reproduction and outputs the image data objects to the image memory 404 to have them stored thereon.

Reading out Y, M, C, and K image data objects from the image memory 404, the laser diode driver 405 drives the laser diodes of the exposure unit 20.

The operation panel 500 allows users to perform entry operations and displays various messages for them.

The recording medium 700 stores print log data, toner cartridge replacement log data, and the like, as well as various other data and applications.

The ROM 406 stores programs to control image forming operation and other data such as a table serving for toner supply control, toner empty detection control, and other controls.

The RAM 407 serves as a work area for the CPU 402.

Receiving signals and state information from the toner empty sensor 84, the TCR sensor 93, a toner cartridge loading sensor (not illustrated in the drawing), a TC door sensor (not illustrated), a front cover (not illustrated), the cartridge motors 72, the sub-hopper motors (not illustrated), and the like, the engine controller 408 controls printing operation.

Figure 7:
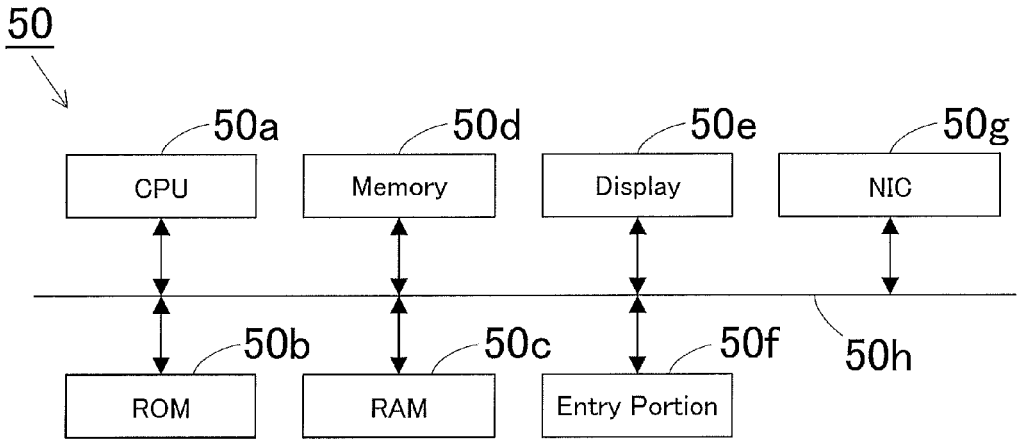
FIG. 7 is a block diagram illustrating a configuration of a replacement toner cartridge management apparatus.

FIG. 7 is a block diagram illustrating a configuration of the management server 50 employed in the replacement toner cartridge management system of FIG. 1.

The management server 50 is provided with a CPU 50*a*, a ROM 50*b*, a RAM 50*c*, a display 50*e*, an entry portion 50*f*, a network interface card (NIC) 50*g*, and the like, which are connected to each other via a system bus 50*h*.

The CPU 50*a* integrally controls the entire management server 50 by executing programs stored on the ROM 50*b*. Specifically, in this mode of embodied implementation, the CPU 50*a* receives and manages information of remaining toner that is a consumable resource remaining in the toner cartridges 70Y, 70M, 70C, and 70K loaded on the image forming apparatuses 51; and information indicating that the toner cartridges 70Y, 70M, 70C, and 70K have been replaced. Also, the CPU 50*a* updates the information when the need arises. Receiving toner cartridge replacement information indicating that the toner cartridge 70Y, 70M, 70C, or 70K loaded on an image forming apparatus 51 has been replaced with a new one, the CPU 50*a* obtains the remaining toner level of the removed toner cartridge or the toner consumption data (print volume, average value of the ratio, Black/White) from the image forming apparatus 51; determines a right time to output an instruction to deliver a replacement toner cartridge; and outputs a delivery instruction at the right time.

The ROM 50*b* is a recording medium that stores programs and data for the CPU 50*a* to execute processing.

The ROM 50*c* is a recording medium that provides a work area for the CPU 50*a* to execute processing according to an operation program.

The recording medium 50*d* is, for example, a hard disk drive, and stores various data, applications, and the like. Specifically, in this mode of embodied implementation, the recording medium 50*d* stores remaining toner information of the toner cartridges 70Y, 70M, 70C, and 70K loaded on the image forming apparatus 51, which is rewritable thereon. Furthermore, the recording medium 50*d* stores information such as the locations of the image forming apparatuses 51 which correspond to the delivery addresses to which replacement toner cartridges and other replacement consumable units such as replacement transfer belt unit, replacement fuser units, and replacement developing units will be delivered.

The display 50*e* is, for example, a CRT display or a liquid-crystal display, and displays various messages, entry accepting screens, selection screens, and other screens for administrator-level users and other users.

The entry portion 50*f* serves for administrator-level users and other users to perform entry operation, and includes a keyboard, a mouse, and the like.

The network interface card 50*g* serves as a communicator that exchanges data with the image forming apparatuses 51 and the order receiving server 52 via the Internet network.

Figure 8:
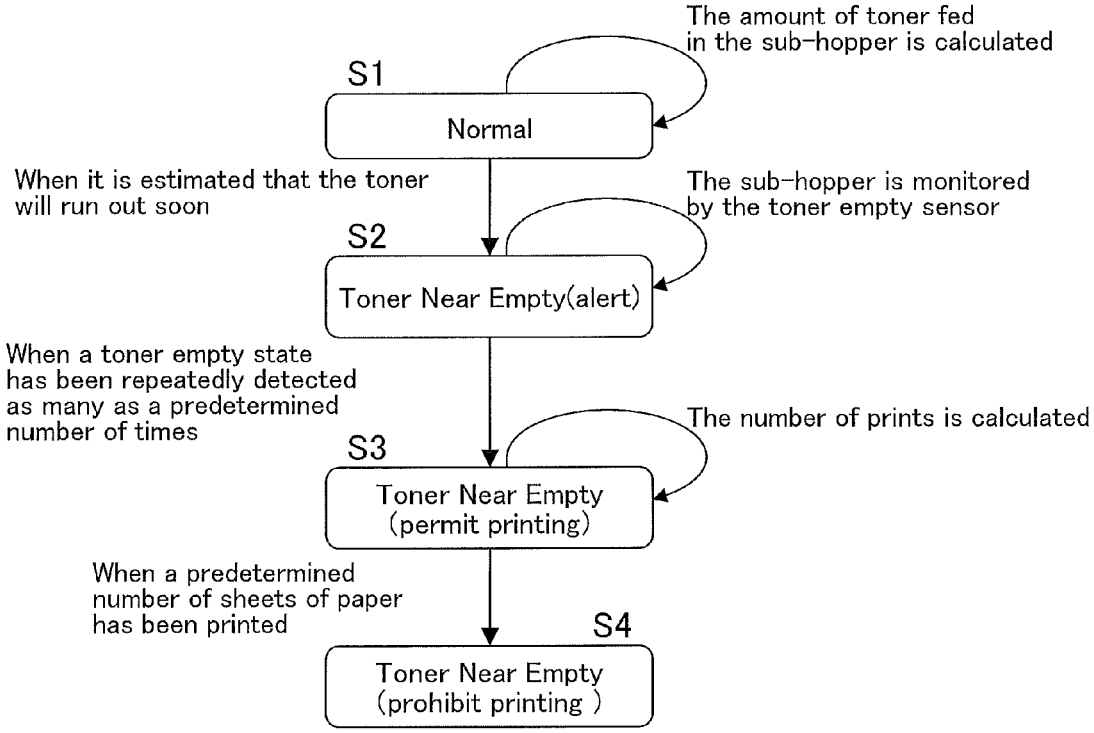
FIG. 8 is a flowchart representing a processing routine to detect a toner empty state.

FIG. 8 is a flowchart representing a processing routine to detect a toner empty state, executed by the image forming apparatuses 51.

In FIG. 8, the remaining toner levels of the toner cartridges 70Y, 70M, 70C, and 70K slowly go down with feeding of toner; the toner cartridges 70Y, 70M, 70C, and 70K eventually run out of toner (become in toner empty state).

There are the four states depending on remaining toner level: "normal" (Step S1), "toner near empty (alert)" (Step S2), "toner empty (permit printing)" (Step S3), and "toner empty (prohibit printing)" (Step S4).

Unlike "toner near empty (alert)" (Step S2), "toner empty (permit printing)" (Step S3), and "toner empty (prohibit printing)" (Step S3), "normal" (Step S1) means that the toner cartridges 70Y, 70M, 70C, and 70K and the sub-hoppers 80Y, 80M, 80C, and 80K are sufficiently filled with toner. In these four states including the state of "normal" (Step S1), the CPU 401 accumulates the rotation quantum numbers of the cartridge motors 72, and estimates the amount of toner fed in the sub-hoppers 80Y, 80M, 80C, and 80K based on the rotation quantum numbers.

Figure 9:
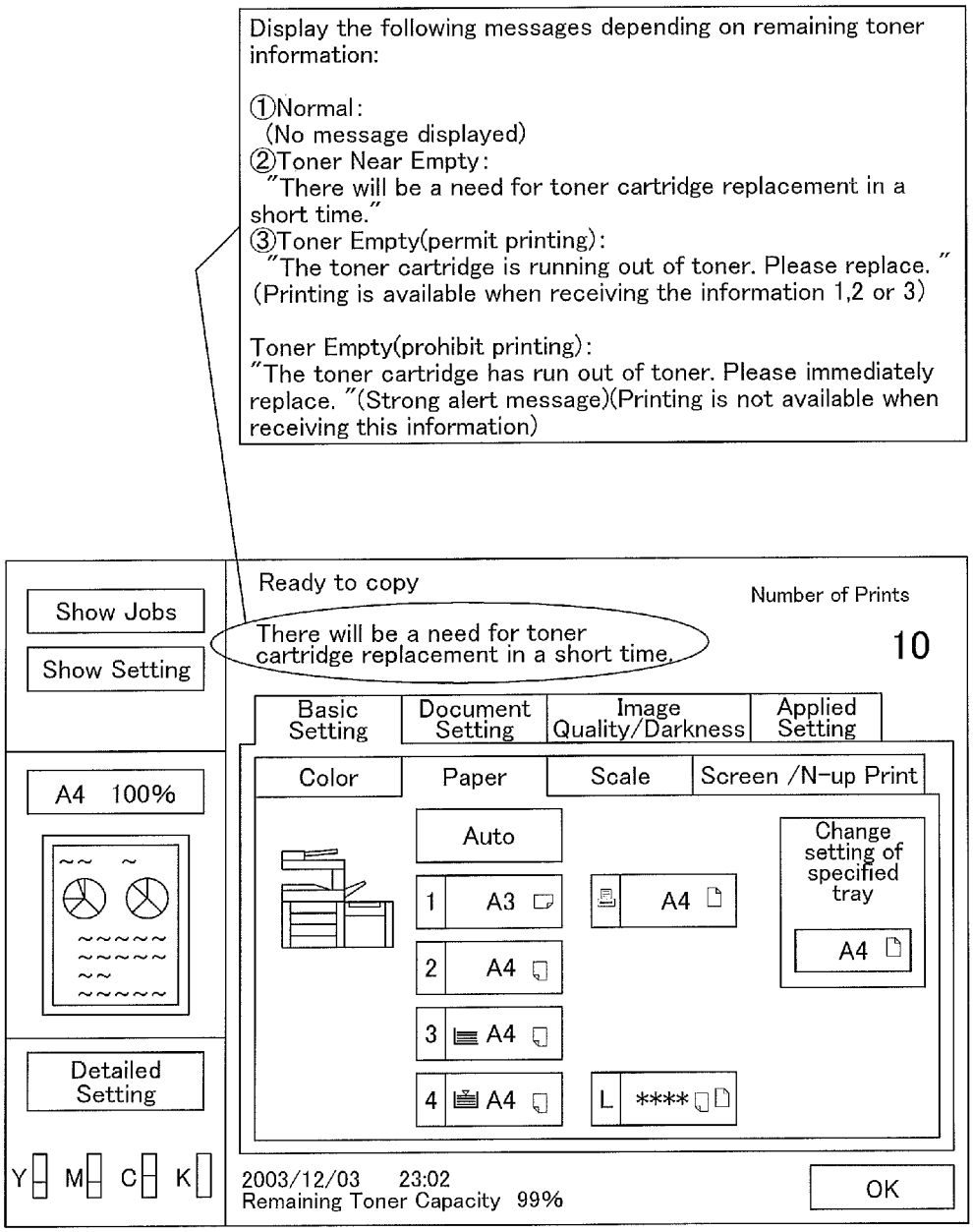
FIG. 9 is a view to explain an example of an alert message displayed on an operation panel of the image forming apparatus.

The CPU 401 determines the state as "toner near empty (alert)" (Step S2) if estimating that the toner cartridges 70Y, 70M, 70C, and 70K nearly run out of toner based on the estimated amount of toner fed in the sub-hoppers 80Y, 80M, 80C, and 80K. In the state of "toner near empty (alert)", as illustrated in FIG. 9, an alert message stating that toner will run out in a short time is displayed on the operation panel 500 so that users will be encouraged to prepare a replacement toner cartridge. After that, thousands of prints still can be made using the toner cartridges 70Y, 70M, 70C and 70K before "toner empty (prohibit printing)" is detected, users therefore have enough time to prepare a replacement toner cartridge even when need to place an order because of no replacement toner cartridges in stock.

The CPU 401 determines the state as "toner empty (permit printing)" (Step S3) when the toner empty sensor 84 has repeatedly detected a toner empty state of the sub-hoppers 80Y, 80M, 80C, and 80K as many as a predetermined number of times. In this state, the toner cartridges 70Y, 70M, 70C, and 70K have no toner left inside while the sub-hoppers 80Y, 80M, 80C, and 80K still contain toner for as many as 100 prints approximately, and printing is therefore permitted.

The CPU 401 determines the state as "toner empty (prohibit printing)" (Step S4) when the sub-hoppers 80Y, 80M, 80C, and 80K run out of toner by further consuming it for a predetermined number of prints after "toner empty (permit printing)" is detected. In this state, printing is prohibited.

In the state of "toner near empty (alert)" (Step S2) and "toner empty (permit printing)" (Step S3), as illustrated in FIG. 9, an alert message is displayed on the operation panel 500 to let the user know that the toner will run out soon. In the state of "toner empty (prohibit printing)" (Step S4), a strong alert message is displayed on the operation panel 500 to let the user know that the toner has run out, and printing is prohibited.

These states depending on remaining toner level: normal, toner near empty, toner empty (permit printing), and toner empty (prohibit printing) (described in Steps S1 to S4, respectively) are incorporated in a table illustrated in FIG. 10.

As is obviously understood from the table of FIG. 10, when the state turns to "toner empty (permit printing)" (Step S3), it is acceptable to replace the toner cartridges 70Y, 70M, 70C, and 70K since these contain little remaining toner (almost run out of toner); when the state turns to "toner near empty" (Step S2), it is not preferred to replace the toner cartridges 70Y, 70M, 70C, and 70K since these still contain some remaining toner.

Figure 11:
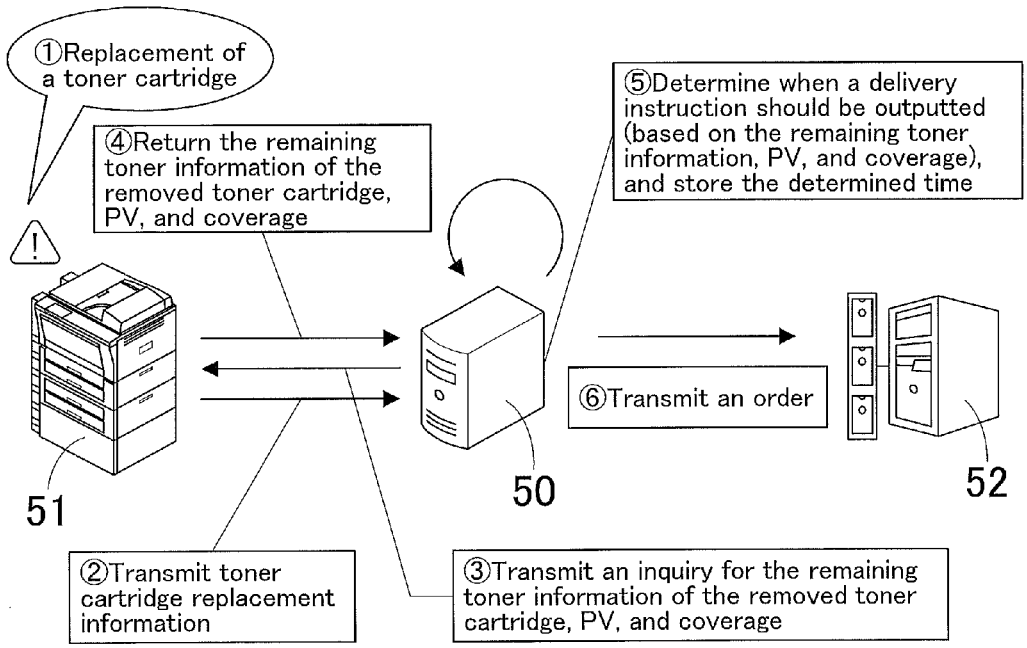
FIG. 11 is a view to explain the overview of a procedure executed by a replacement toner cartridge management system according to one mode of embodied implementation to determine the right time to output an instruction to deliver a replacement toner cartridge and output such an instruction.
Figure 12:
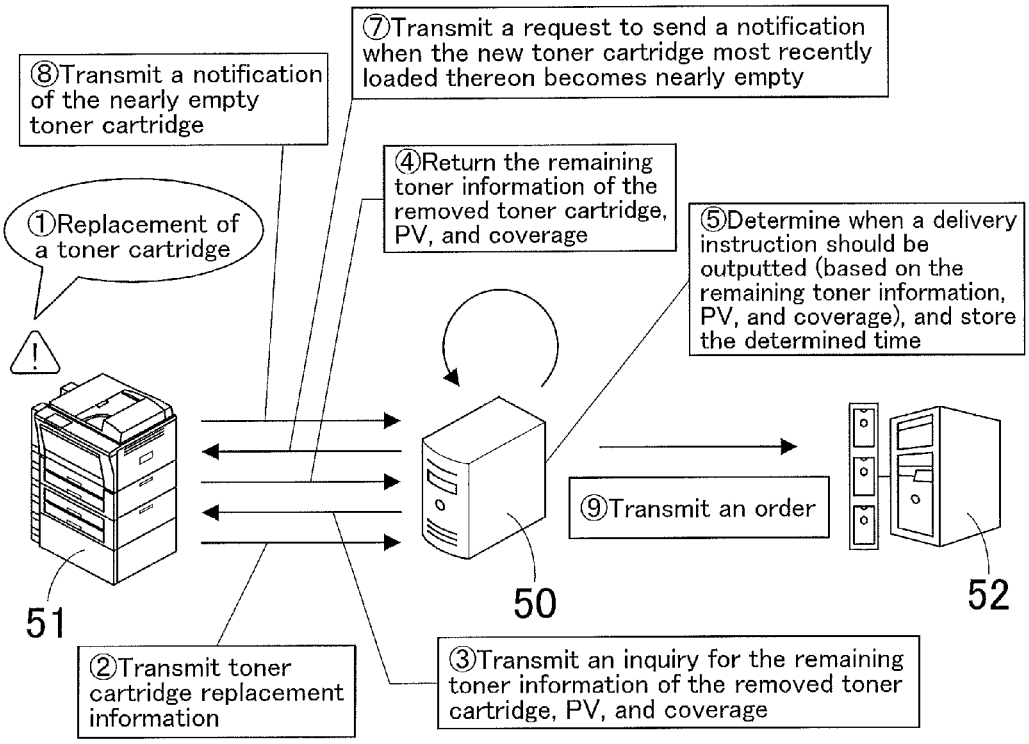
FIG. 12 is another view to explain the overview of a procedure executed by a replacement toner cartridge management system according to one mode of embodied implementation to determine the right time to output an instruction to deliver a replacement toner cartridge and output such an instruction.
Figure 13:
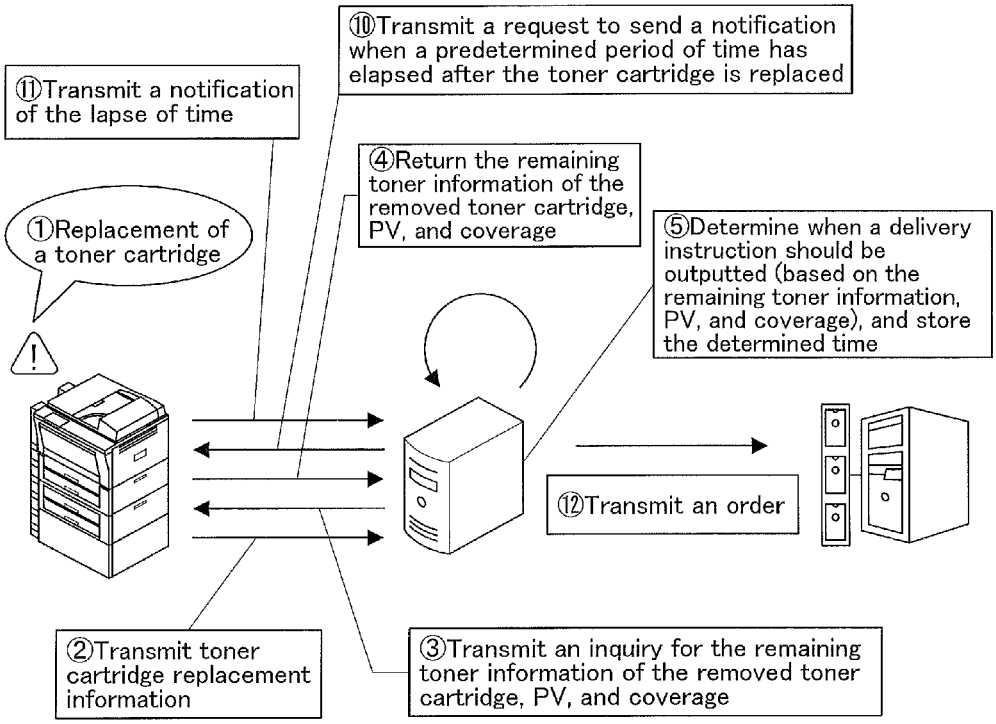
FIG. 13 is yet another view to explain the overview of a procedure executed by a replacement toner cartridge management system according to one mode of embodied implementation to determine the right time to output an instruction to deliver a replacement toner cartridge and output such an instruction.

FIGS. 11, 12, and 13 are views to explain examples of a procedure executed by a replacement toner cartridge management system according to one mode of embodied implementation to determine the right time to output an instruction to deliver a replacement toner cartridge and output such an instruction, in which different delivery instructions are outputted.

In the mode of embodied implementation illustrated in FIGS. 11, 12, and 13, the management server 50 determines the right time to output an instruction to deliver a replacement toner cartridge, based on remaining toner information of a toner cartridge to be replaced, paper volume (also referred to as PV), and average value (also referred to as coverage) of the ratio, black (B)/white (W) which are received form an image forming apparatus 51.

FIG. 11 illustrates an example of a procedure to determine that a delivery instruction should be outputted when a toner cartridge is replaced with a new one, which starts when a toner cartridge in toner empty (permit printing) state or toner empty (prohibit printing) state, i.e. containing little remaining toner is replaced with a new one.

Initially, a toner cartridge loaded on an image forming apparatus 51 is replaced (circled number 1). Then the image forming apparatus 51 transmits information indicating a toner cartridge has been replaced with a new one, to the management server 50 connected therewith via a communication circuit (circled number 2).

As is previously mentioned, replacement of the toner cartridges is recognized when their attached fuses are cut out. When having its fuse conductive, the image forming apparatus 51 detects the cartridge detection signal as "new toner cartridge"; when having the fuse cut out, it detects the cartridge detection signal as "old toner cartridge".

Receiving the toner cartridge replacement information from the image forming apparatus 51, the management server 50 returns thereto an inquiry for remaining toner information of the toner cartridge having been replaced (also referred to as remaining toner information of the removed toner cartridge), the PV, and the coverage (circled number 3).

And the image forming apparatus 51 accordingly returns the remaining toner information of the removed toner cartridge, the PV, and the coverage (circled number 4).

Based on the information received from the image forming apparatus 51, the management server 50 determines the right time to output an instruction to deliver a replacement toner cartridge, and records the determined time (circled number 5).

A delivery instruction will be outputted according to the determination. In this example of FIG. 11, the management server 50 determines that a delivery instruction should be outputted when the toner cartridge is replaced with a new one, and therefore outputs a delivery instruction immediately after the determination (circled number 6).

FIG. 12 illustrates an example of a procedure to determine that a delivery instruction should be outputted when a toner cartridge becomes nearly empty, e.g. eventually when the new toner cartridge most recently loaded becomes near empty, if the PV and the coverage are smaller than their second predetermined values that are smaller than their first predetermined values, which starts when a toner cartridge in toner near empty state or normal state (normal toner condition) prior to toner near empty state, i.e. still containing some remaining toner is replaced with a new one.

The operations with the circled numbers 1 to 5 are the same as described with reference to FIG. 11. In this example of FIG. 12, the management server 50 determines that a delivery instruction should be outputted when a toner cartridge becomes nearly empty, e.g. eventually when the new toner cartridge most recently loaded becomes nearly empty, and therefore requests the image forming apparatus 51 to return a notification when the new toner cartridge most recently loaded thereon becomes nearly empty (circled number 7). And receiving from the image forming apparatus 51 a notification of the nearly empty toner cartridge (circled number 8), the management server 50 outputs an instruction to deliver a replacement toner cartridge (circled number 9).

FIG. 13 illustrates an example of a procedure to determine that a delivery instruction should be outputted when a predetermined period of time has elapsed after a toner cartridge is replaced with a new one, if the PV and the coverage are smaller than their first predetermined values but either of them is larger than or equal to their second predetermined values, which starts when a toner cartridge in toner near empty state or normal state prior to toner near empty state, i.e. still containing some remaining toner is replaced with a new one.

In this example, the management server 50 requests the image forming apparatus 51 to return a notification when a predetermined period of time has elapsed after the toner cartridge is replaced (circled number 10). And receiving from the image forming apparatus 51 a notification indicating that a predetermined period of time has elapsed after then (circled number 11), the management server 50 outputs an instruction to deliver a replacement toner cartridge (circled number 12).

Figure 14:
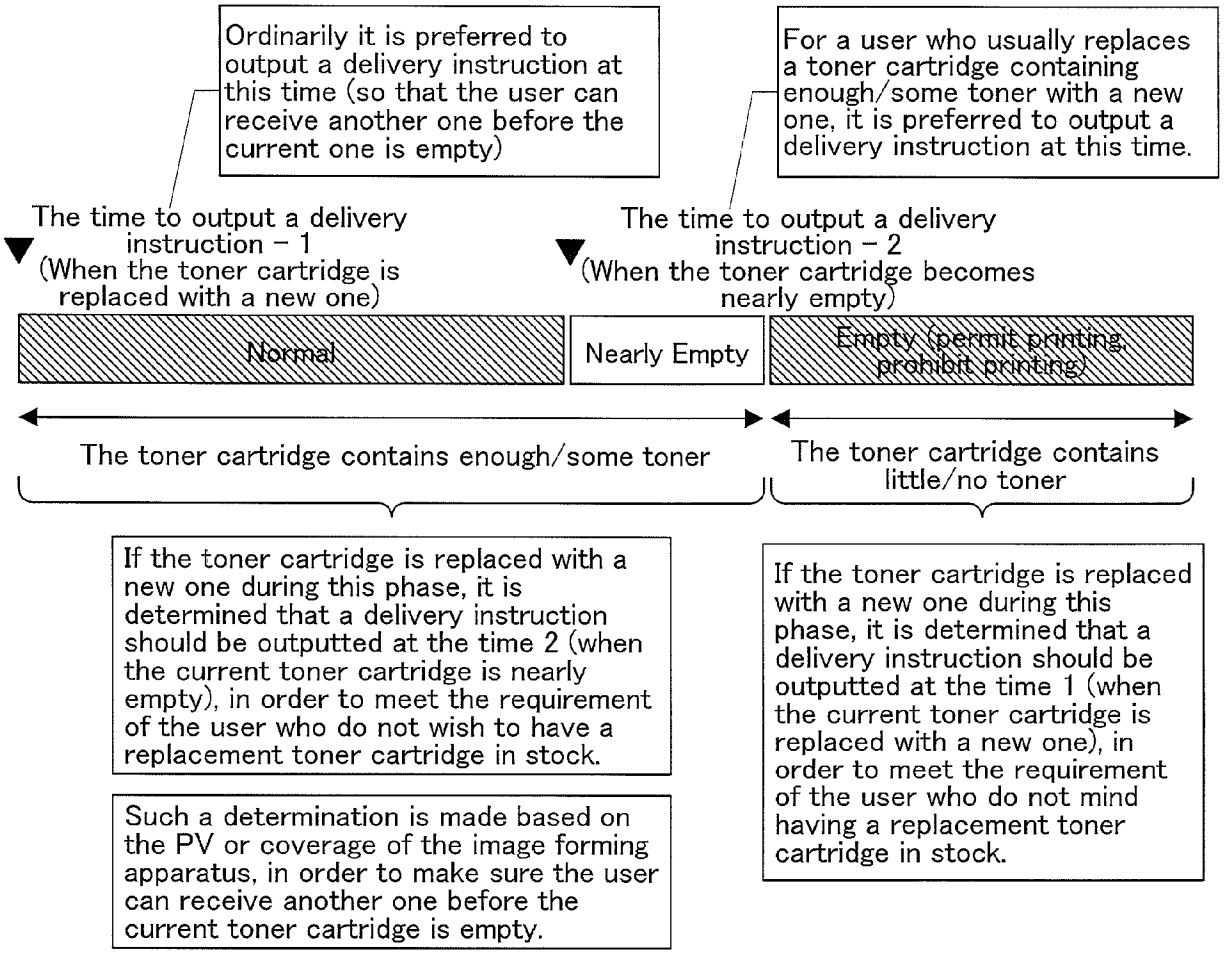
FIG. 14 is a view to explain some cases in which the right time to output an instruction to deliver a replacement toner cartridge is determined.

FIG. 14 is a view to explain some cases in which the right time to output an instruction to deliver a replacement toner cartridge is determined. Each of the cases is started with the management server 50's outputting a delivery instruction when a toner cartridge is replaced with a new one (when the management server 50 receives information indicating that a toner cartridge has been replaced with a new one). In this mode of embodied implementation: a first predetermined value for PV is 500 printed pages per day; a second predetermined value for PV is 100 printed pages per day; a first predetermined value for coverage is 75%; and a second predetermined value for coverage is 25%, and a predetermined period of time required for printing 500 pages needs to elapse since the toner cartridge is replaced.

When a toner cartridge in toner near empty state or normal state is replaced with a new one, i.e. a toner cartridge still containing some remaining toner is replaced with a new one, the management server 50 determines that a delivery instruction should be outputted when another toner cartridge becomes nearly empty, which will meet the object of saving toner and the requirement of users who wish to have as least replacement toner cartridges in stock as possible. Meanwhile, when a toner cartridge in toner empty state (permit printing or prohibit printing) is replaced with a new one, the management server 50 determines that a delivery instruction should be outputted now, right after the replacement of a toner cartridge as usual.

Some practical cases of this mode of embodied implementation hereinafter will be described.

[Case—1]

In Case 1, receiving toner cartridge replacement information from an image forming apparatus 51, the management server 50 returns thereto an inquiry for remaining toner information, the PV, and the coverage, then receives them all; the received remaining toner information is toner empty (permit printing) or toner empty (prohibit printing), for example.

Further in this case, the user of the image forming apparatus 51 replaces a toner cartridge with a new one when it is in toner empty state, i.e. when it contains little remaining toner. On the basis of the facts, the management server 50 recognizes that the user wishes to have a replacement toner cartridge as soon as possible, before the printing is prohibited due to toner empty (prohibit printing). And it is preferred to replace a toner cartridge containing little remaining toner with a new one, and the management server 50 therefore determines that a delivery instruction should be outputted when a toner cartridge is replaced with a new one (when receiving the toner cartridge replacement information) as indicated by circled number 1 of FIG. 14, regardless of the PV and the coverage received from the image forming apparatus 51.

[Case—2]

In Case 2, receiving toner cartridge replacement information from an image forming apparatus 51, the management server 50 returns thereto an inquiry for remaining toner information, the PV, and the coverage, then receives them all; the received remaining toner information is toner near empty or normal, for example.

Further in this case, the user of the image forming apparatus 51 replaces a toner cartridge with a new one when it is in toner near empty state or normal state, i.e. when it still contains some remaining toner. On the basis of the facts that the PV is smaller than its second predetermined value, 100 printed pages per day, and the coverage is smaller than its second predetermined value, 25%, the user possibly wishes to have at least replacement toner cartridges in stock as possible, and if outputting a delivery instruction later to meet the user's requirement, the low level of toner consumption possibly allows the user to receive a replacement toner cartridge before printing is prohibited due to toner empty (prohibit printing). However, it is not preferred to replace a toner cartridge still contains some remaining toner with a new one, and the management server 50 therefore determines that a delivery instruction should be outputted when a toner cartridge becomes nearly empty (as indicated by circled number 2 of FIG. 14).

[Case—3]

In Case 3, receiving toner cartridge replacement information from an image forming apparatus 51, the management server 50 returns thereto an inquiry for remaining toner information, the PV, and the coverage, then receives them all; the received remaining toner information is toner near empty or normal, and the received PV and coverage are larger than or equal to their second predetermined values, for example.

In this case, toner will run out more rapidly than in Case 2, since the PV and the coverage are larger than or equal to their second predetermined values. If the management server 50 determines that a delivery instruction should be outputted when a toner cartridge becomes nearly empty as in Case 2, the user possibly fails to receive a replacement toner cartridge before printing is prohibited due to toner empty (prohibit printing).

To prevent the inconvenience, even when a toner cartridge in a toner near empty state or normal state is replaced with a new one: the management server 50 determines that a delivery instruction should be outputted when a toner cartridge is replaced with a new one (when receiving toner cartridge replacement information) as indicated by circled number 1 of FIG. 14, if the PV is larger than or equal to its first predetermined value, 500 printed pages per day or the coverage is larger than or equal to its first predetermined value, 75%.

Alternatively, the management server 50 determines that a delivery instruction should be outputted when a predetermined period of time required for printing 500 pages has elapsed after a toner cartridge is replaced with a new one, if the PV is smaller than its first predetermined value, 500 printed pages per day and the coverage is smaller than its first predetermined value 75%; or if the PV is larger than or equal to its second predetermined value, 100 printed pages per day or the coverage is larger than or equal to its second predetermined value, 25%.

FIG. 15 illustrates a table containing the information provided above. In FIG. 15, the circle symbol indicates that a delivery instruction should be outputted when a toner cartridges is replaced with a new one (when receiving toner cartridge replacement information); the triangle symbol indicates that a delivery instruction should be outputted when a predetermined period of time has elapsed after a toner cartridge is replaced with a new one; and the x-mark symbol indicates that a delivery instruction should be outputted when a toner cartridge becomes nearly empty.

In this mode of embodied implementation, when a toner cartridge in toner near empty state or normal state is replaced with new one: it is determined to output an instruction to deliver a replacement toner cartridge at a right time based on toner consumption data such as the PV and the coverage, so that the user can receive a replacement toner cartridge properly before the new toner cartridge most recently loaded becomes empty. Specifically, when a toner cartridge is replaced with a new one and toner cartridge replacement information is received, a delivery instruction will be outputted immediately if the level of toner consumption is high; a delivery instruction will be outputted after a certain period of time if the level of toner consumption is rather high; and a delivery instruction will be outputted when the new toner cartridge most recently loaded becomes empty, if the level of toner consumption is low.

In this way, the user can receive a replacement toner cartridge for the currently loaded toner cartridge nicely right before it becomes empty. This would contribute to eliminating a waste of toner.

Figure 16:
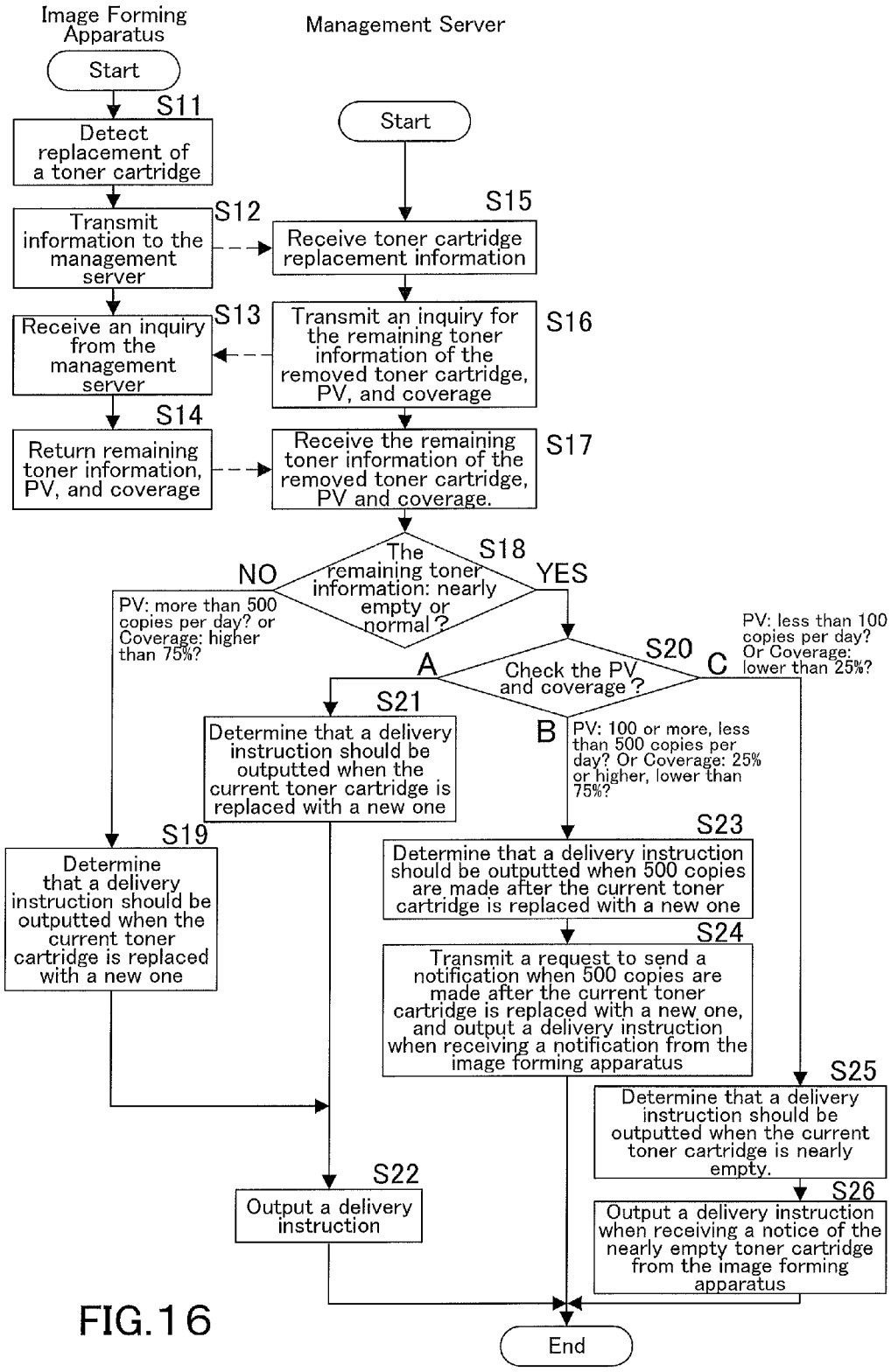
FIG. 16 is a flowchart representing a processing routine executed by the management server to determine the right time to output an instruction to deliver a replacement toner cartridge, which starts when an image forming apparatus detects replacement of a toner cartridges loaded thereon.

FIG. 16 is a flowchart representing a processing routine executed by the management server 50 to determine the right time to output an instruction to deliver a replacement toner cartridge, which starts when an image forming apparatus 51 detects replacement of a toner cartridge loaded thereon. The processing routine is executed by the CPU 50*a* of the management server 50 according to an operation program stored on a recording medium such as the ROM 50*b*.

In Step S11, an image forming apparatus 51 detects replacement or the toner near empty state of a toner cartridge loaded thereon, and then in Step S12, the image forming apparatus 51 transmits toner cartridge replacement information to the management server 50.

Receiving the toner cartridge replacement information in Step S15, the management server 50 returns to the image forming apparatus 51 causing the toner cartridge replacement information, an inquiry for the remaining toner level of the toner cartridge (remaining toner information), the PV, and the coverage, in Step S16.

Receiving this inquiry from the management server 50 in Step S13, the image forming apparatus 51 returns thereto the remaining toner information, the PV, and the coverage in Step S14.

Receiving the remaining toner information, the PV, and the coverage in Step S17, the management server 50 judges whether or not the remaining toner information is toner near empty or normal, i.e. whether or not the toner cartridge still contained some toner when it was replaced with a new one, in Step S18.

If the remaining toner information is not toner near empty or normal, i.e. if the toner cartridge was in toner near empty state when it was replaced with a new one (NO in Step S18), it is judged that an instruction to deliver a replacement toner cartridge should be outputted when a toner cartridge is replaced with a new one (when receiving toner cartridge replacement information) in Step S19. And then, a delivery instruction is outputted in Step S22.

If the remaining toner information is toner near empty or normal (YES in Step S18), the PV and the coverage are compared to their reference values in Step S20.

If the PV is larger than or equal to its first predetermined value, 500 printed pages per day or the coverage is larger than or equal to its first predetermined value, 75% (State A in Step S20), it is determined that an instruction to deliver a replacement toner cartridge should be outputted when a toner cartridge is replaced with a new one (when receiving toner cartridge replacement information) in Step S21. And then, a delivery instruction is outputted in Step S22.

In Step S20, if the PV is larger than or equal to its second predetermined value, 100 printed pages per day but smaller than its first predetermined value, 500 printed pages per day; or if the coverage is larger than or equal to its second predetermined value 25% but smaller than its first predetermined value, 75% (State B in Step S20), it is determined that an instruction to deliver a replacement toner cartridge should be outputted when 500 pages have been completely printed after a toner cartridge is replaced with a new one (after receiving toner cartridge replacement information) in Step S23. And then in Step S24, the image forming apparatus 51 is instructed to issue a notification when having completely printed 500 pages after a toner cartridge is replaced with a new one and a delivery instruction is outputted when there is such a notification.

In Step S20, if the PV is smaller than its second predetermined value, 100 printed pages per day and the coverage is smaller than its second predetermined value, 25% (State C in Step S20), it is determined that an instruction to deliver a replacement toner cartridge should be outputted when a toner cartridge becomes nearly empty in Step S25. And then in Step S26, a delivery instruction is outputted when a notification of toner near empty is received from the image forming apparatus 51.

The modes of implementing the present invention have been described in the foregoing specification, which does not mean that the present invention shall be construed as limited to the particular forms disclosed. For example, the PV and the coverage are employed as information indicating toner consumption. Alternatively, information obtained by a counter to count the number of printed pages by paper size may be employed.

The management server 50 receives toner cartridge replacement information, remaining toner information, the PV, and the coverage; determines the right time to output an instruction to deliver a replacement toner cartridge; and outputs a delivery instruction (outputs an order). Instead of the management server 50, one image forming apparatus 51 may collectively have all these functions of the management server 50 so as to receive toner cartridge replacement information, remaining toner information, the PV, and the coverage; determine the right time to output an instruction to deliver a replacement toner cartridge; and output a delivery instruction (output an order). In this case, the operations described above are performed according to an operation program by the control of the CPU 401 of the image forming apparatus 51.

Specifically, in these modes of embodied implementation, an order receiving server 52 is employed in the management system, and the management server 50 outputs a delivery instruction to the order receiving server 52. Alternatively, the management server 50 may display a message encouraging the user to place an order, on its own display 50*e* or a display of another machine such as a personal computer. In such a case, an order placement operation is manually performed.

Alternatively, the consumable units may be those dedicated for inkjet image forming apparatuses.

Each of the following is one aspect of the present invention of the subject application having been described above: a replacement toner cartridge management apparatus which contributes to eliminating a waste of toner by reducing the amount of toner remaining in a toner cartridge to be replaced with a new one; a replacement toner cartridge management system; an image forming apparatus; a replacement toner cartridge management method; and recording mediums.

[1] A replacement toner cartridge management apparatus provided with:

a receiver which receives toner cartridge replacement information indicating a toner cartridge loaded on an image forming apparatus which the replacement toner cartridge management apparatus can access via a communication circuit, has been replaced with a new one;

an information obtainer which obtains remaining toner information of the toner cartridge removed from the image forming apparatus, when the toner cartridge replacement information is received by the receiver;

a time determiner which, if the remaining toner information obtained by the information obtainer indicates a value smaller than a predetermined value, determines that an instruction to deliver a replacement toner cartridge should be outputted when the toner cartridge replacement information is received, or if the remaining toner information indicates a value larger than or equal to a predetermined value, determines that an instruction to deliver a replacement toner cartridge should be outputted at a different time; and a transmitter which outputs a delivery instruction according to the determination made by the time determiner.

[2] The replacement toner cartridge management apparatus as recited in the aforementioned item [1], wherein the time determiner determines the right time to output an instruction to deliver a replacement toner cartridge based on the toner consumption data of the image forming apparatus, if the remaining toner information indicates a value larger than or equal to the predetermined value.

[3] The replacement toner cartridge management apparatus as recited in the aforementioned item [2], wherein:

the toner consumption data is a print volume; and if the print volume is larger than or equal to a first predetermined value, the time determiner determines that an instruction to deliver a replacement toner cartridge should be outputted when the toner cartridge replacement information is received; if the print volume is smaller than the first predetermined value and is larger than or equal to a second predetermined value that is smaller than the first predetermine value, the time determiner determines that an instruction to deliver a replacement toner cartridge should be outputted when a period of time has elapsed after the receipt of the toner cartridge replacement information; or if the print volume is smaller than the second predetermined value, the time determiner determines that an instruction to deliver a replacement toner cartridge should be outputted when the currently loaded toner cartridge becomes nearly empty.

[4] The replacement toner cartridge management apparatus as recited in the aforementioned item [3], wherein:

the toner consumption data is an average value of the ratio White to Black; and if the average value of the ratio White to Black is larger than or equal to a first predetermined value, the time determiner determines that an instruction to deliver a replacement toner cartridge should be outputted when the toner cartridge replacement information is received; if the average value of the ratio White to Black is smaller than the first predetermined value and is larger than or equal to a second predetermined value that is smaller than the first predetermined value, the time determiner determines that an instruction to deliver a replacement toner cartridge should be outputted when a period of time has elapsed after the receipt of the toner cartridge replacement information; or if the average value of the ratio White to Black is smaller than the second predetermined value, the time determiner determines that an instruction to deliver a replacement toner cartridge should be outputted when the currently loaded toner cartridge becomes nearly empty.

[5] The replacement toner cartridge management apparatus recited in the aforementioned item [1], wherein the transmitter outputs a delivery instruction to an order receiving server which the replacement toner cartridge management apparatus can access via the communication circuit.

[6] An image forming apparatus provided with:

a receiver which receives toner cartridge replacement information indicating that a toner cartridge loaded on the image forming apparatus or a different image forming apparatus which the image forming apparatus can access via a communication circuit has been replaced with a new one;

an information obtainer which obtains remaining toner information of the removed toner cartridge when the toner cartridge replacement information is received by the receiver;

a time determiner which, if the remaining toner information obtained by the information obtainer indicates a value smaller than a predetermined value, determines that an instruction to deliver a replacement toner cartridge should be outputted when the toner cartridge replacement information is received, or if the remaining toner information indicates a value larger than or equal to a predetermined value, determines that an instruction to deliver a replacement toner cartridge should be outputted at a different time; and a transmitter which outputs a delivery instruction at the time determined by the time determiner.

[7] The image forming apparatus as recited in the aforementioned item [6], wherein the time determiner determines the right time to output an instruction to deliver a replacement toner cartridge based on the toner consumption data of the image forming apparatus, if the remaining toner information indicates a value larger than or equal to the predetermined value.

[8] The image forming apparatus as recited in the aforementioned item [7], wherein:

the toner consumption data is a print volume; and if the print volume is larger than or equal to a first predetermined value, the time determiner determines that an instruction to deliver a replacement toner cartridge should be outputted when the toner cartridge replacement information is received; if the print volume is smaller than the first predetermined value and is larger than or equal to a second predetermined value that is smaller than the first predetermine value, the time determiner determines that an instruction to deliver a replacement toner cartridge should be outputted when a period of time has elapsed after the receipt of the toner cartridge replacement information; or if the print volume is smaller than the second predetermined value, the time determiner determines that an instruction to deliver a replacement toner cartridge should be outputted when the currently loaded toner cartridge becomes nearly empty.

[9] The image forming apparatus as recited in the aforementioned item [7], wherein:

the toner consumption data is an average value of the ratio White to Black; and if the average value of the ratio White to Black is larger than or equal to a first predetermined value, the time determiner determines that an instruction to deliver a replacement toner cartridge should be outputted when the toner cartridge replacement information is received; if the average value of the ratio White to Black is smaller than the first predetermined value and is larger than or equal to a second predetermined value that is smaller than the first predetermined value, the time determiner determines that an instruction to deliver a replacement toner cartridge should be outputted when a period of time has elapsed after the receipt of the toner cartridge replacement information; or if the average value of the ratio White to Black is smaller than the second predetermined value, the time determiner determines that an instruction to deliver a replacement toner cartridge should be outputted when the currently loaded toner cartridge becomes nearly empty.

[10] The image forming apparatus as recited in the aforementioned item [6], wherein the transmitter outputs a delivery instruction to an order receiving server which the replacement toner cartridge management apparatus can access via the communication circuit.

[11] A replacement toner cartridge management system provided with an image forming apparatus having one or more than one toner cartridge loaded thereon and a management apparatus which can access each other via a communication circuit, wherein:

the image forming apparatus is provided with a transmitter which transmits toner cartridge replacement information indicating that one of the toner cartridges has been replaced with a new one, and the management apparatus is provided with:

a receiver which receives the toner cartridge replacement information;

an information obtainer which obtains remaining toner information of the removed toner cartridge when the toner cartridge replacement information is received by the receiver;

a time determiner which, if the remaining toner information obtained by the information obtainer indicates a value smaller than a predetermined value, determines that an instruction to deliver a replacement toner cartridge should be outputted when the toner cartridge replacement information is received, or if the remaining toner information indicates a value larger than or equal to a predetermined value, determines that an instruction to deliver a replacement toner cartridge should be outputted at a different time; and a transmitter which outputs a delivery instruction at the time determined by the time determiner.

[12] The replacement toner cartridge management system as recited in the aforementioned item [11], wherein the time determiner determines the right time to output an instruction to deliver a replacement toner cartridge based on the toner consumption data of the image forming apparatus, if the remaining toner information indicates a value larger than or equal to the predetermined value.

[13] The replacement toner cartridge management system as recited in the aforementioned item [12], wherein:

the toner consumption data is a print volume; and if the print volume is larger than or equal to a first predetermined value, the time determiner determines that an instruction to deliver a replacement toner cartridge should be outputted when the toner cartridge replacement information is received; if the print volume is smaller than the first predetermined value and is larger than or equal to a second predetermined value that is smaller than the first predetermine value, the time determiner determines that an instruction to deliver a replacement toner cartridge should be outputted when a period of time has elapsed after the receipt of the toner cartridge replacement information; or if the print volume is smaller than the second predetermined value, the time determiner determines that an instruction to deliver a replacement toner cartridge should be outputted when the currently loaded toner cartridge becomes nearly empty.

[14] The replacement toner cartridge management system as recited in the aforementioned item [12], wherein:

the toner consumption data is an average value of the ratio White to Black; and if the average value of the ratio White to Black is larger than or equal to a first predetermined value, the time determiner determines that an instruction to deliver a replacement toner cartridge should be outputted when the toner cartridge replacement information is received; if the average value of the ratio White to Black is smaller than the first predetermined value and is larger than or equal to a second predetermined value that is smaller than the first predetermined value, the time determiner determines that an instruction to deliver a replacement toner cartridge should be outputted when a period of time has elapsed after the receipt of the toner cartridge replacement information; or if the average value of the ratio White to Black is smaller than the second predetermined value, the time determiner determines that an instruction to deliver a replacement toner cartridge should be outputted when the currently loaded toner cartridge becomes nearly empty.

[15] The replacement toner cartridge management system as recited in the aforementioned item [1], wherein the transmitter outputs a delivery instruction to an order receiving server which the replacement toner cartridge management apparatus can access via the communication circuit.

[16] A replacement toner cartridge management method for a system provided with an image forming apparatus having one or more than one toner cartridge loaded thereon and a management apparatus which can access each other via a communication circuit, including:

the image forming apparatus's transmitting toner cartridge replacement information indicating one of the toner cartridges has been replaced with a new one, and the management apparatus's:

receiving the toner cartridge replacement information;

obtaining remaining toner information of the removed toner cartridge when the toner cartridge replacement information is received;

if the obtained remaining toner information indicates a value smaller than a predetermined value, determining that an instruction to deliver a replacement toner cartridge should be outputted when the toner cartridge replacement information is received, or if the obtained remaining toner information indicates a value larger than or equal to a predetermined value, determining that an instruction to deliver a replacement toner cartridge should be outputted at a different time; and outputting a delivery instruction according to the determination.

[17] A non-transitory computer-readable recording medium having a replacement toner cartridge management program stored thereon to make a computer of a management apparatus execute:

receiving toner cartridge replacement information indicating a toner cartridge loaded on an image forming apparatus which the management apparatus can access via a communication circuit has been replaced with a new one;

obtaining remaining toner information of the removed toner cartridge when the toner cartridge replacement information is received;

if the obtained remaining toner information indicates a value smaller than a predetermined value, determining that an instruction to deliver a replacement toner cartridge should be outputted when the toner cartridge replacement information is received, or if the obtained remaining toner information indicates a value larger than or equal to a predetermined value, determining that an instruction to deliver a replacement toner cartridge should be outputted at a different time; and outputting a delivery instruction according to the determination.

[18] A non-transitory computer-readable recording medium having a replacement toner cartridge management program stored thereon to make a computer of an image forming apparatus execute:

receiving toner cartridge replacement information indicating a toner cartridge loaded on the image forming apparatus or a different image forming apparatus which the image forming apparatus can access via a communication circuit has been replaced with a new one;

obtaining remaining toner information of the removed toner cartridge when the toner cartridge replacement information is received;

if the obtained remaining toner information indicates a value smaller than a predetermined value, determining that an instruction to deliver a replacement toner cartridge should be outputted when the toner cartridge replacement information is received, or if the obtained remaining toner information indicates a value larger than or equal to a predetermined value, determining that an instruction to deliver a replacement toner cartridge should be outputted at a different time; and outputting a delivery instruction according to the determination.

According to the mode as recited in the aforementioned item [1], if the remaining amount of toner contained in the removed toner cartridge is smaller than a predetermined level, it is determined that an instruction to deliver a replacement toner cartridge should be outputted when toner cartridge replacement information is received; if the remaining amount of toner contained in the removed toner cartridge is larger than a predetermined level, it is determined that an instruction to deliver a replacement toner cartridge should be outputted at a different time. And a delivery instruction is outputted according to the determination.

Conventionally, an instruction to deliver a replacement toner cartridge is outputted when toner cartridge replacement information is received. On the other hand, if the remaining amount of toner contained in the removed toner cartridge is large, a delivery instruction is outputted at a different time so that the user will receive a replacement toner cartridge nicely when the remaining amount of toner is small. In this way, a waste of toner is eliminated.

According to the mode as recited in the aforementioned item [2], if the remaining amount of toner is larger than a predetermined level, the time to output an instruction to deliver a replacement toner cartridge is determined more accurately, based on the toner consumption data of the image forming apparatus. In this way, the user receives a replacement toner cartridge nicely when the remaining amount of toner is small.

According to the mode as recited in the aforementioned item [3], the time to output an instruction to deliver a replacement toner cartridge is determined more accurately, based on a print volume.

According to the mode as recited in the aforementioned item [4], the time to output an instruction to deliver a replacement toner cartridge is determined more accurately, based on an average value of the ratio White to Black.

According to the mode as recited in the aforementioned item [5], an order for a necessary replacement toner cartridge is automatically transmitted to the order receiving server.

According to the mode as recited in the aforementioned item [6], if the remaining amount of toner contained in the removed toner cartridge is large, an instruction to deliver a replacement toner cartridge is outputted at a different time so that the user will receive a replacement toner cartridge nicely when the remaining amount of toner is small. By executing such a process, the image forming apparatus contributes to eliminating a waste of toner.

According to the mode as recited in the aforementioned item [7], if the remaining amount of toner is larger than a predetermined level, the time to output an instruction to deliver a replacement toner cartridge is determined based on the toner consumption data of the image forming apparatus or a different image forming apparatus.

According to the mode as recited in the aforementioned item [8], the time to output an instruction to deliver a replacement toner cartridge is determined more accurately, based on a print volume.

According to the mode as recited in the aforementioned item [9], the time to output an instruction to deliver a replacement toner cartridge is determined more accurately, based on an average value of the ratio White to Black.

According to the mode as recited in the aforementioned item [10], an order for a necessary replacement toner cartridge is automatically transmitted to the order receiving server.

According to the mode as recited in the aforementioned item [11], if the remaining amount of toner contained in the removed toner cartridge is large, an instruction to deliver a replacement toner cartridge is outputted at a different time so that the user will receive a replacement toner cartridge nicely when the remaining amount of toner is small. By executing such a process, the replacement toner cartridge management system contributes to eliminating a waste of toner.

According to the mode as recited in the aforementioned item [12], if the remaining amount of toner is larger than a predetermined level, the time to output an instruction to deliver a replacement toner cartridge is determined based on the toner consumption data of the image forming apparatus or a different image forming apparatus.

According to the mode as recited in the aforementioned item [13], the time to output an instruction to deliver a replacement toner cartridge is determined more accurately, based on a print volume.

According to the mode as recited in the aforementioned item [14], the time to output an instruction to deliver a replacement toner cartridge is determined more accurately, based on an average value of the ratio White to Black.

According to the mode as recited in the aforementioned item [15], an order for a necessary replacement toner cartridge is automatically transmitted to the order receiving server.

According to the mode as recited in the aforementioned item [16], if the remaining amount of toner contained in the removed toner cartridge is large, a delivery instruction is outputted at a different time so that the user will receive a replacement toner cartridge nicely when the remaining amount of toner is small. In this way, a waste of toner is eliminated.

According to the mode as recited in the aforementioned item [17], if the remaining amount of toner contained in the removed toner cartridge is large, a delivery instruction is outputted at a different time so that the user will receive a replacement toner cartridge nicely when the remaining amount of toner is small. By executing such a process, a computer of the replacement toner cartridge management apparatus contributes to eliminating a waste of toner.

According to the mode as recited in the aforementioned item [18], if the remaining amount of toner contained in the removed toner cartridge is large, a delivery instruction is outputted at a different time so that the user will receive a replacement toner cartridge nicely when the remaining amount of toner is small. By executing such a process, a computer of the image forming apparatus contributes to eliminating a waste of toner.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. A replacement toner cartridge management apparatus being characterized by having:

a receiver to receive toner cartridge replacement information indicating that a toner cartridge has been replaced with a new one, from an image forming apparatus which can be accessed by the replacement toner cartridge management apparatus via a line of communication;

an information obtainer to obtain remaining toner information of the toner cartridge having been replaced, when the toner cartridge replacement information is received by the receiver;

a time determiner to: adjust the time to output an instruction to deliver a replacement toner cartridge to the point of time of receiving the toner cartridge replacement information, if the amount of remaining toner obtained by the information obtainer is less than a predetermined value; and adjust the time to output an instruction to deliver a replacement toner cartridge to another point of time than that of receiving the toner cartridge replacement information, if the amount of remaining toner is greater than the predetermined value; and a transmitter to output an instruction to deliver a replacement toner cartridge in accordance with the determination of the time determiner.

2. The replacement toner cartridge management apparatus as recited in claim 1, wherein the time determiner adjusts the time to output an instruction to deliver a replacement toner cartridge, on the basis of the amount of toner consumed by the image forming apparatus, if the amount of remaining toner is greater than the predetermined value.

3. The replacement toner cartridge management apparatus as recited in claim 2, wherein:

the amount of toner consumed is a print volume; and the time determiner adjusts the time to output an instruction to deliver a replacement toner cartridge to the point of time of receiving the toner cartridge replacement information, if the print volume is a first predetermined value or greater;

adjusts the time to output an instruction to deliver a replacement toner cartridge to a point of time later than receiving the toner cartridge replacement information, if the print volume is less than the first predetermined value while being a second predetermined value or greater, the second predetermined value being less than the first predetermined value; and adjusts the time to output an instruction to deliver a replacement toner cartridge to the point of time of detecting a toner-near-empty event in the new toner cartridge having been loaded, if the print volume is less than the second predetermined value.

4. The replacement toner cartridge management apparatus as recited in claim 2, wherein:

the amount of toner consumed is an average value of the ratio of White to Black; and the time determiner adjusts the time to output an instruction to deliver a replacement toner cartridge to the point of time of receiving the toner cartridge replacement information, if the average value of the ratio of White to Black is a first predetermined value or greater; adjusts the time to output an instruction to deliver a replacement toner cartridge to a point of time later than receiving the toner cartridge replacement information, if the average value of the ratio of White to Black is less than the first predetermined value while being a second predetermined value or greater, the second predetermined value being less than the first predetermined value; and adjusts the time to output an instruction to deliver a replacement toner cartridge to the point of time of detecting a toner-near-empty event in the new toner cartridge having been loaded, if the average value of the ratio of White to Black is less than the second predetermined value.

5. The replacement toner cartridge management apparatus recited in claim 1, wherein the transmitter outputs the delivery instruction to an order receiving server which can be accessed by the replacement toner cartridge management apparatus via the line of communication.

6. An image forming apparatus being characterized by having:

a receiver to receive toner cartridge replacement information indicating that a toner cartridge loaded on the image forming apparatus itself or a different image forming apparatus which can be accessed by the image forming apparatus via a line of communication, has been replaced with a new one;

an information obtainer to obtain remaining toner information of the toner cartridge having been replaced, when the toner cartridge replacement information is received by the receiver;

a time determiner to: adjust the time to output an instruction to deliver a replacement toner cartridge to the point of time of receiving the toner cartridge replacement information, if the amount of remaining toner obtained by the information obtainer is less than a predetermined value; and adjust the time to output an instruction to deliver a replacement toner cartridge to another point of time than that of receiving the toner cartridge replacement information, if the amount of remaining toner is greater than the predetermined value; and a transmitter to output an instruction to deliver a replacement toner cartridge in accordance with the determination of the time determiner.

7. The image forming apparatus as recited in claim 6, wherein the time determiner adjusts the time to output an instruction to deliver a replacement toner cartridge, on the basis of the amount of toner consumed by the image forming apparatus itself or the different image forming apparatus, if the amount of remaining toner is greater than the predetermined value.

8. The image forming apparatus as recited in claim 7, wherein:

the amount of toner consumed is a print volume; and the time determiner adjusts the time to output an instruction to deliver a replacement toner cartridge to the point of time of receiving the toner cartridge replacement information, if the print volume is a first predetermined value or greater;

adjusts the time to output an instruction to deliver a replacement toner cartridge to a point of time later than receiving the toner cartridge replacement information, if the print volume is less than the first predetermined value while being a second predetermined value or greater, the second predetermined value being less than the first predetermined value; and adjusts the time to output an instruction to deliver a replacement toner cartridge to the point of time of detecting a toner-near-empty event in the new toner cartridge having been loaded, if the print volume is less than the second predetermined value.

9. The image forming apparatus as recited in claim 7, wherein:

the amount of toner consumed is an average value of the ratio of White to Black; and the time determiner adjusts the time to output an instruction to deliver a replacement toner cartridge to the point of time of receiving the toner cartridge replacement information, if the average value of the ratio of White to Black is a first predetermined value or greater;

adjusts the time to output an instruction to deliver a replacement toner cartridge to a point of time later than receiving the toner cartridge replacement information, if the average value of the ratio of White to Black is less than the first predetermined value while being a second predetermined value or greater, the second predetermined value being less than the first predetermined value; and adjusts the time to output an instruction to deliver a replacement toner cartridge to the point of time of detecting a toner-near-empty event in the new toner cartridge having been loaded, if the average value of the ratio of White to Black is less than the second predetermined value.

10. The image forming apparatus as recited in claim 6, wherein the transmitter outputs the delivery instruction to an order receiving server which can be accessed by the image forming apparatus itself via the line of communication.

11. A replacement toner cartridge management system being characterized by having an image forming apparatus and a management apparatus which can be accessed by each other via a line of communication, the image forming apparatus comprising:

one or more toner cartridges; and a transmitter to transmit toner cartridge replacement information indicating that any one of the one or more toner cartridges has been replaced with a new one, the management apparatus comprising:

a receiver to receive the toner cartridge replacement information;

an information obtainer to obtain remaining toner information of the toner cartridge having been replaced, when the toner cartridge replacement information is received by the receiver;

a time determiner to: adjust the time to output an instruction to deliver a replacement toner cartridge to the point of time of receiving the toner cartridge replacement information, if the amount of remaining toner obtained by the information obtainer is less than a predetermined value; and adjust the time to output an instruction to deliver a replacement toner cartridge to another point of time than that of receiving the toner cartridge replacement information, if the amount of remaining toner is greater than the predetermined value; and a transmitter to output an instruction to deliver a replacement toner cartridge in accordance with the determination of the time determiner.

12. The replacement toner cartridge management system as recited in claim 11, wherein the time determiner adjusts the time to output an instruction to deliver a replacement toner cartridge, on the basis of the amount of toner consumed by the image forming apparatus, if the amount of remaining toner is greater than the predetermined value.

13. The replacement toner cartridge management system as recited in claim 12, wherein:

the amount of toner consumed is a print volume; and the time determiner adjusts the time to output an instruction to deliver a replacement toner cartridge to the point of time of receiving the toner cartridge replacement information, if the print volume is a first predetermined value or greater;

adjusts the time to output an instruction to deliver a replacement toner cartridge to a point of time later than receiving the toner cartridge replacement information, if the print volume is less than the first predetermined value while being a second predetermined value or greater, the second predetermined value being less than the first predetermined value; and adjusts the time to output an instruction to deliver a replacement toner cartridge to the point of time of detecting a toner-near-empty event in the new toner cartridge having been loaded, if the print volume is less than the second predetermined value.

14. The replacement toner cartridge management system as recited in claim 12, wherein:

the amount of toner consumed is an average value of the ratio of White to Black; and the time determiner adjusts the time to output an instruction to deliver a replacement toner cartridge to the point of time of receiving the toner cartridge replacement information, if the average value of the ratio of White to Black is a first predetermined value or greater; adjusts the time to output an instruction to deliver a replacement toner cartridge to a point of time later than receiving the toner cartridge replacement information, if the average value of the ratio of White to Black is less than the first predetermined value while being a second predetermined value or greater, the second predetermined value being less than the first predetermined value; and adjusts the time to output an instruction to deliver a replacement toner cartridge to the point of time of detecting a toner-near-empty event in the new toner cartridge having been loaded, if the average value of the ratio of White to Black is less than the second predetermined value.

15. The replacement toner cartridge management system as recited in claim 11, wherein the transmitter outputs the delivery instruction to an order receiving server which can be accessed by the image forming apparatus and the management apparatus via the line of communication.

16. A replacement toner cartridge management method to be implemented by a system comprising an image forming apparatus and a management apparatus which can be accessed by each other via a line of communication, the image forming apparatus comprising one or more toner cartridges, the replacement toner cartridge management method being characterized by having: the following step of the image forming apparatus:

transmitting toner cartridge replacement information indicating any one of the one or more toner cartridges has been replaced with a new one, and the following steps of the management apparatus:

receiving the toner cartridge replacement information;

obtaining remaining toner information of the toner cartridge having been replaced, when the toner cartridge replacement information is received;

adjusting the time to output an instruction to deliver a replacement toner cartridge to the point of time of receiving the toner cartridge replacement information, if the amount of remaining toner obtained is less than a predetermined value; and adjusting the time to output an instruction to deliver a replacement toner cartridge to another point of time than that of receiving the toner cartridge replacement information, if the amount of remaining toner is greater than the predetermined value; and outputting an instruction to deliver a replacement toner cartridge in accordance with the determination.

17. A non-transitory computer-readable recording medium storing a replacement toner cartridge management program to make a computer execute the following steps:

receiving toner cartridge replacement information indicating that a toner cartridge loaded on the image forming apparatus or a different image forming apparatus which can be accessed by the image forming apparatus via a line of communication, has been replaced with a new one;

obtaining remaining toner information of the toner cartridge having been replaced, when the toner cartridge replacement information is received;

adjusting the time to output an instruction to deliver a replacement toner cartridge to the point of time of receiving the toner cartridge replacement information, if the amount of remaining toner obtained is less than a predetermined value; and adjusting the time to output an instruction to deliver a replacement toner cartridge to another point of time than that of receiving the toner cartridge replacement information, if the amount of remaining toner is greater than the predetermined value; and outputting an instruction to deliver a replacement toner cartridge in accordance with the determination.

18. A non-transitory computer-readable recording medium storing a replacement toner cartridge management program to make a computer of an image forming apparatus execute the following steps:

receiving toner cartridge replacement information indicating that a toner cartridge loaded on the image forming apparatus or a different image forming apparatus which can be accessed by the image forming apparatus via a line of communication, has been replaced with a new one;

obtaining remaining toner information of the toner cartridge having been replaced, when the toner cartridge replacement information is received;

adjusting the time to output an instruction to deliver a replacement toner cartridge to the point of time of receiving the toner cartridge replacement information, if the amount of remaining toner obtained is less than a predetermined value; and adjust the time to output an instruction to deliver a replacement toner cartridge to another point of time than that of receiving the toner cartridge replacement information, if the amount of remaining toner is greater than the predetermined value; and outputting an instruction to deliver a replacement toner cartridge in accordance with the determination.

* * * * *